US010994430B2

(12) United States Patent
Wang

(10) Patent No.: US 10,994,430 B2
(45) Date of Patent: May 4, 2021

(54) UTILITY KNIFE WITH DUAL BLADES

(71) Applicants: Hangzhou Great Star Industrial Co., Ltd., Hangzhou (CN); Hangzhou Great Star Tools Co., Ltd., Hangzhou (CN)

(72) Inventor: Weiyi Wang, Hangzhou (CN)

(73) Assignees: Hangzhou Great Star Industrial Co., Ltd., Zhe (CN); Hangzhou Great Star Tools Co., Ltd., Zhe (CN)

( * ) Notice: Subject to any disclaimer, the term of this patent is extended or adjusted under 35 U.S.C. 154(b) by 7 days.

(21) Appl. No.: 16/335,479

(22) PCT Filed: Sep. 23, 2016

(86) PCT No.: PCT/CN2016/099850
§ 371 (c)(1),
(2) Date: Mar. 21, 2019

(87) PCT Pub. No.: WO2018/053796
PCT Pub. Date: Mar. 29, 2018

(65) Prior Publication Data

US 2019/0210233 A1 Jul. 11, 2019

(51) Int. Cl.

| | |
|---|---|
| ***B26B 5/00*** | (2006.01) |
| ***B26B 1/08*** | (2006.01) |
| ***B26B 29/02*** | (2006.01) |
| ***B26B 1/10*** | (2006.01) |

(52) U.S. Cl.
CPC ..... *B26B 5/003* (2013.01); *B26B 1/10* (2013.01); *B26B 5/001* (2013.01); *B26B 29/02* (2013.01)

(58) Field of Classification Search
CPC ..... B26B 5/003; B26B 1/10; B26B 5/001; B26B 29/02
(Continued)

(56) References Cited

U.S. PATENT DOCUMENTS 4,498,236 A * 2/1985 McIntyre ..... B26B 21/24 30/34.1
5,093,994 A * 3/1992 Karas ..... B26B 5/001 30/125
(Continued)

FOREIGN PATENT DOCUMENTS

CN 2605973 Y 3/2004
CN 201249449 Y 6/2009
(Continued)

OTHER PUBLICATIONS

International Search Report for International Patent Application No. PCT/CN2016/099850 dated Jun. 21, 2017.

*Primary Examiner* — Hwei-Siu C Payer
(74) *Attorney, Agent, or Firm* — Andrus Intellectual Property Law, LLP

(57) ABSTRACT

The present utility model discloses a utility knife with dual blades, comprising a housing having an opening at both ends, a blade carrier which is mounted and is movable within the housing, a movement assembly connected to the blade carrier for driving the blade carrier to respectively move in a direction towards both ends of the housing, wherein it further comprises a stop member. The blade carrier is provided with an abutment portion thereon, and the stop member has a stop portion being able to change its position with respect to the abutment portion, so that the blade carrier can move in a single direction so as to prevent the blade carrier from accidentally sliding and pushing the blade out to injure a user.

10 Claims, 14 Drawing Sheets

(58) Field of Classification Search
USPC ..... 30/152, 162
See application file for complete search history.

(56) References Cited

U.S. PATENT DOCUMENTS

| | | | | |
|---|---|---|---|---|
| 5,230,152 | A | 7/1993 | Kennedy | |
| 5,906,049 | A * | 5/1999 | Butts | B26B 5/001 30/125 |
| 6,148,522 | A * | 11/2000 | Dobandi | B26B 5/001 30/162 |
| 6,848,185 | B2 * | 2/2005 | Tebo | B26B 9/02 30/125 |
| 7,185,435 | B1 * | 3/2007 | Tseng | B26B 5/001 30/152 |
| 9,108,323 | B2 * | 8/2015 | Billado, Jr. | B26B 1/02 |
| 10,219,567 | B2 * | 3/2019 | Farnum | D05B 89/00 |
| 2002/0188309 | A1 * | 12/2002 | Adelman | B26B 29/02 606/167 |
| 2003/0028973 | A1 * | 2/2003 | Johnson | B26B 5/003 7/160 |
| 2010/0223793 | A1 | 9/2010 | Hansen et al. | |
| 2014/0373363 | A1 * | 12/2014 | Billado, Jr. | B26B 1/08 30/152 |
| 2019/0210233 | A1 * | 7/2019 | Wang | B26B 29/02 |
| 2020/0156269 | A1 * | 5/2020 | Sullivan | B26B 5/001 |

FOREIGN PATENT DOCUMENTS

| | | | |
|---|---|---|---|
| CN | 102189558 | A | 9/2011 |
| CN | 102189558 | B | 4/2013 |
| GB | 2232371 | B | 3/1993 |

* cited by examiner

UTILITY KNIFE WITH DUAL BLADES

CROSS-REFERENCE TO RELATED APPLICATIONS

This application is the U.S. national stage application of International Application PCT/CN2016/099850, filed Sep. 23, 2016.

FIELD OF THE INVENTION

The present utility model relates to the field of hand tools, and in particular relates to a utility knife with dual blades.

DESCRIPTION OF THE PRIOR ART

The utility knife is a very common tool in hand tools, and the utility knife is also used in a wide variety of applications, can be used in various occasions for cutting, and pertains to a standard household tool. However, the use of utility knife is very unsafe, especially for children. Thus, the safety performance of the utility knife is very important. Currently, there is a utility knife with dual blades on the market, both ends of which can be used, and it is very convenient, but this also increases the unsafety.

The Chinese utility model patent "TWO-WAY UTILITY KNIFE" (Patent Number ZL201110108136.0, Authorization Publication No.: CN102189558B) discloses such a utility knife with dual blades, in which blades can extend from both ends of a knife handle, and the structure of which includes a knife handle, a blade carrier, a pushing assembly and two blades. The blade carrier are movably mounted within the knife handle, the pushing assembly is connected to the blade carrier and is exposed outside the knife handle, and the blade carrier is provided at both ends with a retractable latch. The knife handle is provided with a first position, an intermediate position and a second position for positioning the pushing assembly. One blade mounted on the blade carrier extends out of the knife handle and the other blade is retracted into the knife handle when the pushing assembly is positioned in the first position or the second position, and the two blades mounted on the blade carrier are both retracted into the knife handle when the pushing assembly is positioned in the intermediate position.

However, the design of the two-way utility knife lacks a protection device, because the two-way knife is, when used, divided into a working end and a handheld end, and the blade at the handheld end may extend out due to false operation during the use of the working end of the knife, which exhibits certain potential risks.

SUMMARY OF THE UTILITY MODEL

One object of the present utility model is to provide a utility knife with dual blades having a security protection design to avoid accidental injury to a user.

To solve the above-described problem, the present utility model provides a utility knife with dual blades, including a housing having a first end and a second end; a blade carrier for carrying two blades at both ends thereof, respectively, which is mounted and is movable within the housing to enable the blade to extend from either of the first end and the second end of the housing; and a movable member for movably moving to the other end opposite to either of the first end or the second end so as to block the blade from extending out from the other end opposite to either of the first end or the second end.

In another embodiment, the movable member includes a sheath for fitting over an edge of the first end or the second end.

In another embodiment, the movable member is translatably mounted on the housing for moving along the housing towards the first end or the second end, respectively, the movable member has a movable guard on both sides for guarding at the first end and the second end.

In another embodiment, one end of the movable member is connected to an intermediate portion of the housing and the other end can move to the first end or the second end of the housing, respectively, and the other end of the movable member is connected to a guard for guarding at the first end or the second end.

In another embodiment, one end of the movable member is connected to the intermediate portion of the housing via a shaft, so that the movable member is rotatable about the shaft so as to be movable to both ends of the housing, respectively.

Further, the movable member further includes a through hole located in the movable member, a button capable of passing through the through hole, and an elastic member connected to the button.

Further, the upper housing has a button hole in a position corresponding to the button thereon, for accommodating the pressed button on the movable member.

Further, when the blade carrier is in the intermediate position of the housing, a groove is provided in a position corresponding to the button hole on the blade carrier, the groove is engaged with the button and the elastic member; and only when the blade carrier is in the intermediate position of the housing, the elastic member can be engaged with the groove through the button hole so that the elastic member can be compressed within the groove.

Further, the utility knife with dual blades according to the present utility model further includes a rotating member located between the housing and the blade carrier, which is connected to the movable member via a shaft, such as a first shaft or a second shaft, and is rotatable along with the rotation of the movable member, the rotating member has a blocking portion located on one side portion of the rotating member, and the blocking portion is rotated on the rotating member to the side adjacent to the movable member when the movable member rotates to one end of the housing, so as to block the blade carrier from moving towards the end at which the movable member is located.

Further, a forwardly projecting boss is provided in the intermediate position of the blade carrier, and the blocking portion is located on the side of the boss adjacent to the movable member when the movable member rotates to one end of the housing so that the blocking portion can block the boss on the blade carrier from moving towards one end of the movable member.

Further, a structural body is provided at the rear portion of the movable member, the structural body has a pin hole in the center thereof, and a pin is connected to the movable member through the pin hole.

Further, the structural body is connected to the movable member by two fixing members on both sides of the pin hole in the center, respectively, so that the structural body is fixed to the movable member.

Further, the structural body is connected to an elastic structure which is fixedly connected to or integrally extends with the intermediate position of the structural body, and the elastic structure includes two fins which respectively extend towards the both sides from the intermediate position and project inwardly at the ends.

Further, the movable member is provided with a rib which may be engaged with the housing to prevent the movable member from fluctuating up and down.

Further, the movable member fits the size of the housing so as to accommodate the housing within the movable member, and one end of the movable member is connected to the housing via a shaft and the movable member is fixed on the other end through a pin.

Further, the movable member includes a first movable member and a second movable member which are respectively located on both sides of the housing, the first movable member is connected to an upper housing on the upper side of the housing via a first shaft and the second movable member is connected to a lower housing on the lower side of the housing via a second shaft, the first shaft and the second shaft may be two portions of an integral shaft or may be two separate shafts at both ends of one axis.

Further, the first movable member and the second movable member of the movable member have a first through hole, a first button and a second through hole, a second button in a position adjacent to the ends, respectively, and the first button is located in the first through hole and the second button is located in the second through hole.

Further, the first button and the second button are connected via an elastic body or are integrally formed with the elastic body.

Further, it is characterized in that the elastic body is curved.

Further, the elastic body includes a first portion, a second portion and a third portion, the first portion and the third portion are connected to the first button and the second button, respectively, having a void therebetween and extending towards the same side, and the second portion is located between the first portion and the third portion, both ends of which are connected to the first portion and the third portion, respectively, being above the void and extending towards the opposite side.

Further, the structural body has an inward protrusion in the upper portion and the lower portion, respectively.

Further, the structural body further has a trench on the inward side.

Further, the first shaft connects the first movable member and the upper housing through the handle hole on the first movable member and the housing hole on the upper housing, and both sides of the housing hole further have an elongated slot.

Further, there is a first protective layer between the first housing and the first movable member and there is a second protective layer between the second housing and the second movable member, and the first protective layer and the second protective layer have a hole in the positions of the first shaft and the second shaft, respectively.

In another embodiment, the present utility model further provides a utility knife with dual blades, wherein it includes a housing having an opening at both ends, a blade carrier which is mounted and is movable within the housing, a movement assembly which is connected to the blade carrier for driving the blade carrier to move towards both ends of the housing, respectively, and a stop member having a stop portion; the blade carrier is provided with an abutment portion, the stop portion can change its position with respect to the abutment portion so that the blade carrier can be moved in a desired direction of a user.

Further, the utility knife with dual blades according to the present utility model further includes a trigger member connected to the stop member and provided on the outside of the housing, the trigger member can drive the stop member to move so that the stop portion can change positions on both sides of the abutment portion.

Further, the stop member includes an annular body having a cutout on the side, and the side wall of the annular body opposite to the cutout is the stop portion, the width of the cutout is greater than that of the abutment portion, and the abutment portion can enter the inside of the annular body through the cutout.

Further, the stop member has a connecting portion extending outwardly from one end of the annular body and connected to the trigger member, and the trigger member can drive the annular body to rotate.

Further, the outer surface of the connecting portion has spaced flanges and the inside of the trigger member has corresponding indentations so that the trigger member can be engaged with the connecting portion for rotational movement.

Further, the outside of the trigger member is provided as a circular cover having a through hole in the center thereof, and the trigger member further includes a screw having a rod portion and a head portion connected to the rod portion and having a larger cross section than the rod portion, and the rod portion of the screw can pass through the through hole and the head portion is restricted outside of the through hole of the cover.

Further, the connecting portion further has a connecting hole inside which the screw is accommodated and which is engaged with the screw, so that the trigger member and the stop member are fixed to each other.

Further, the trigger member further has a direction identifier indicating a direction in which the blade carrier can be moved.

Further, the housing further has a first slot, a second slot and a third slot, which are located in a first position, an intermediate position, and a second position, corresponding to the movement assembly, respectively.

Further, the movement assembly includes a manual portion and an extension portion connected to the manual portion, the extension portion further has a lateral shoulder for being snapped into the first slot, the second slot and the third slot.

Further, the stop member includes a bump which can block the abutment portion of the blade carrier.

Further, the stop member has a connecting portion extending outwardly from one end of the bump and connected to the trigger member, and the trigger member can drive the bump to rotate so that the bump can be moved to both sides of the abutment portion, respectively.

In another embodiment, the present utility model further provides a utility knife with dual blades, wherein it includes a housing having an opening at both ends, a blade carrier which is mounted and is movable within the housing, a movement assembly which is connected to the blade carrier for driving the blade carrier to move in a direction towards both ends of the housing, and a stop member; and the blade carrier is provided with an abutment portion, the stop member can change its position with respect to the abutment portion, and the stop member can stop the abutment portion to stop the blade carrier when the stop member is in a stopped position, the stop member releases the abutment portion so that the blade carrier is movable when the stop member is in an unstopped position.

Further, the utility knife with dual blades according to the present utility model further includes a trigger member connected to the stop member and provided on the outside of the housing, and the trigger member can drive the stop member to move, so that the position of the stop portion can be varied between the stopped position and the unstopped position on both sides of the abutment portion.

Further, the abutment portion is specifically a front boss in the intermediate position of the blade carrier, the stop member is a hollow body, and the trigger member is a pushing element connected to the stop member, which can push the stop member to move back and forth, the front boss of the abutment portion is restricted within the hollow body of the stop member when the stop member is in the stopped position, the stop member is moved rearwardly along with the pushing portion after the pushing element is pressed so that the stop member is disengaged from the abutment portion and is moved to the unstopped position, so that the blade carrier can be moved.

The effect of the present utility model is that the stop portion or the bump of the stop member can be respectively moved to both ends of the abutment portion so that the blade carrier cannot be moved in a direction towards the stop position, and instead can only be moved towards the opposite direction so that the blade will not accidentally pop out, thereby achieving safety purposes. In another embodiment, the stop member can stop the abutment portion so that the blade carrier cannot be moved, and the blade carrier can be moved to push the blade when the pushing element drives the stop member out of the stop position. In another embodiment of the present utility model, it is possible to protect the blade from extending out from one side of the housing on which the movable member is located by providing a movable member which can respectively move to both ends of the housing, thus achieving safety purposes.

DETAILED DESCRIPTION OF THE PREFERRED EMBODIMENTS

Embodiment 1

Figure 1:
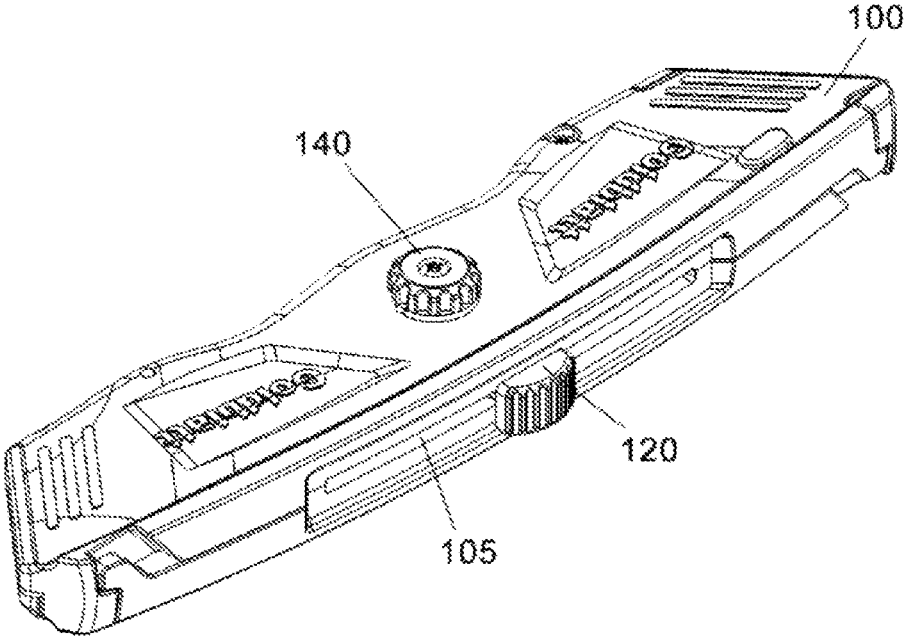
FIG. 1 is an external view of a utility knife with dual blades according to the present utility model.
Figure 2:
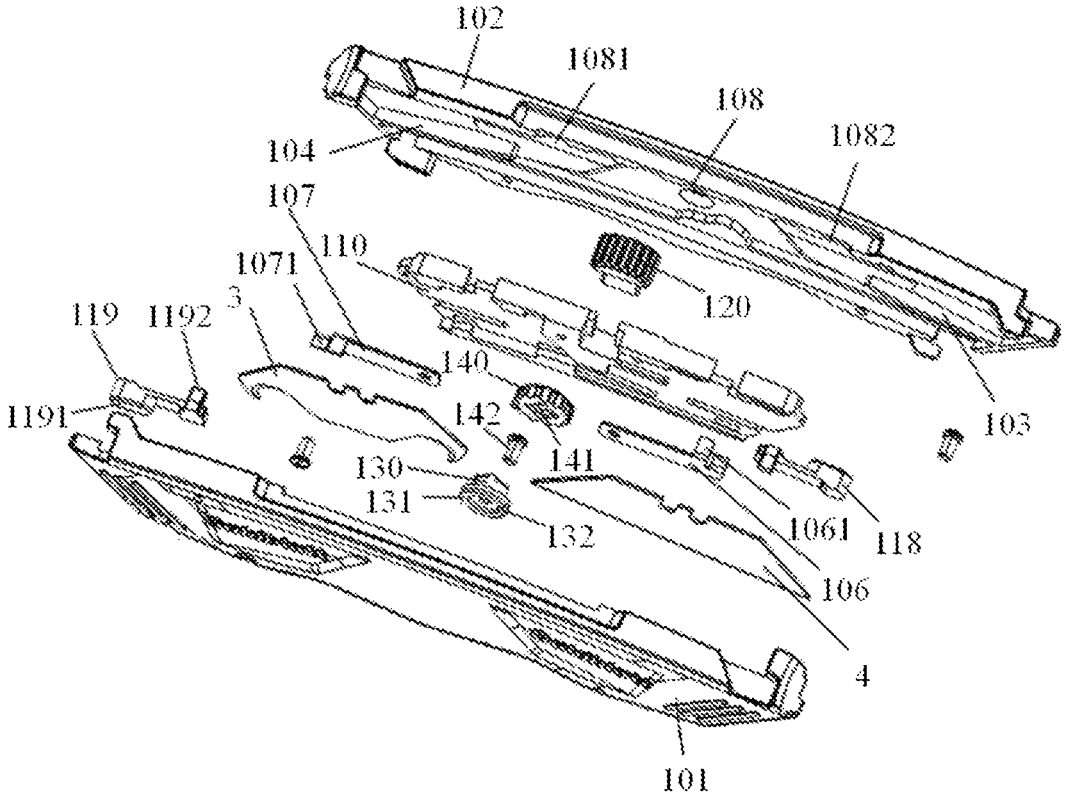
FIG. 2 is an exploded view of a utility knife with dual blades according to the present utility model.
Figure 3:
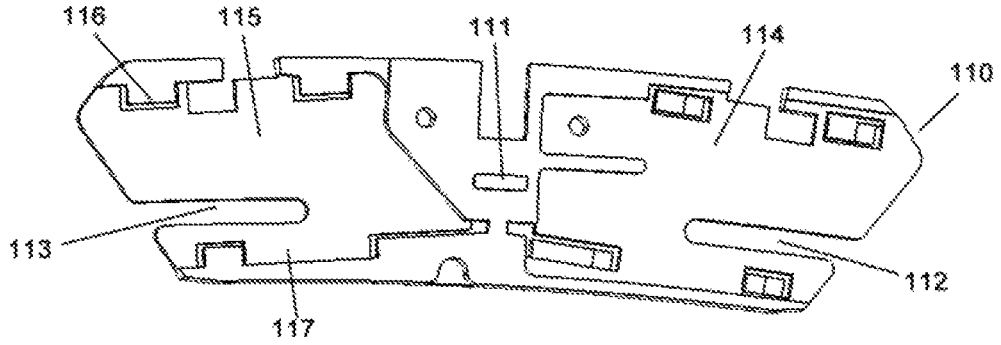
FIG. 3 is a front view of a blade carrier of a utility knife with dual blades according to the present utility model.
Figure 4:
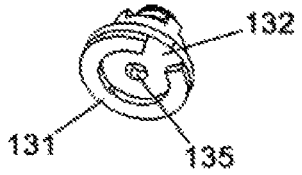
FIG. 4 is a perspective view of a stop member of a utility knife with dual blades according to the present utility model.
Figure 5:
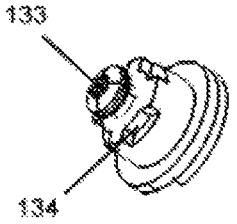
FIG. 5 is a perspective view of a stop member of a utility knife with dual blades according to the present utility model viewed from another direction.
Figure 6:
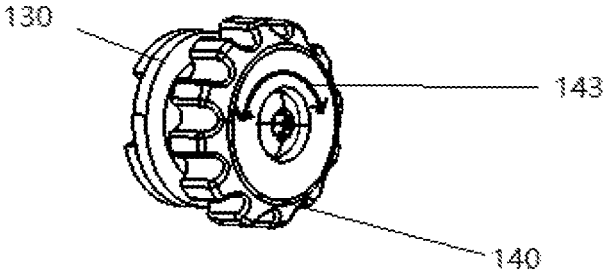
FIG. 6 is a perspective view of a combination of a trigger member and a stop member of a utility knife with dual blades according to the present utility model.
Figure 7:
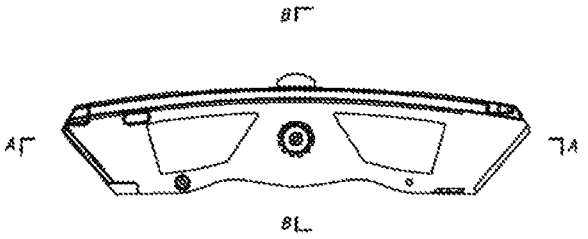
FIG. 7 is a front view of a utility knife with dual blades according to the present utility model.
Figure 8:
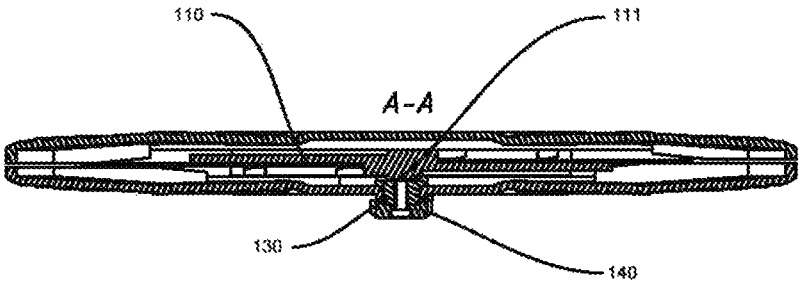
FIG. 8 is a cross-sectional view taken along line A-A of a utility knife with dual blades in FIG. 7 according to the present utility model.
Figure 9:
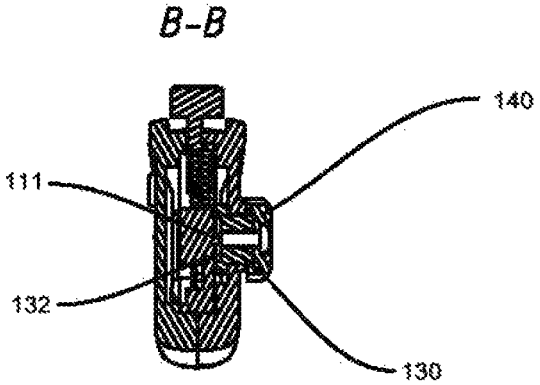
FIG. 9 is a cross-sectional view taken along line B-B of a utility knife with dual blades in FIG. 7 according to the present utility model.
Figure 10:
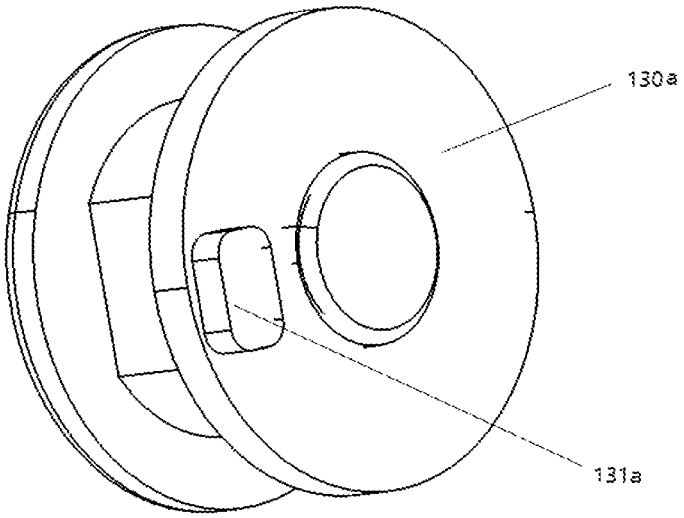
FIG. 10 is a schematic view of a stop member of Embodiment 2 of a utility knife with dual blades according to the present utility model.
Figure 11:
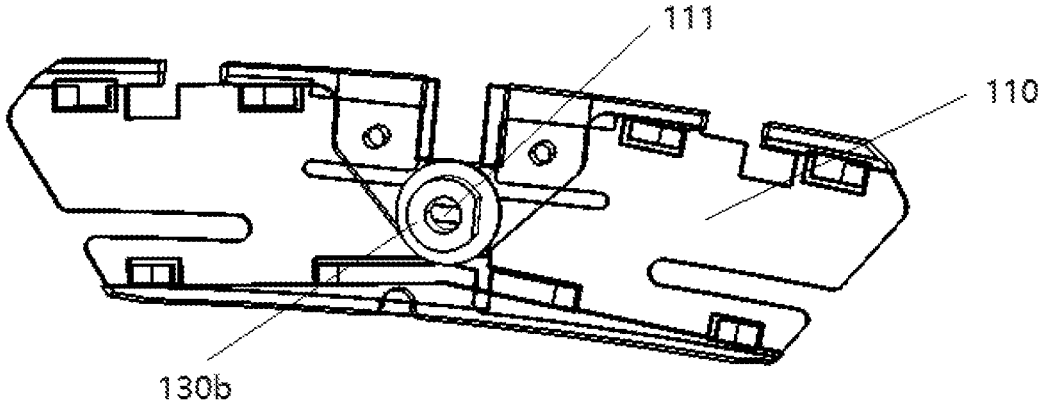
FIG. 11 is a schematic view of a stop member of Embodiment 3 of a utility knife with dual blades according to the present utility model.
Figure 12:
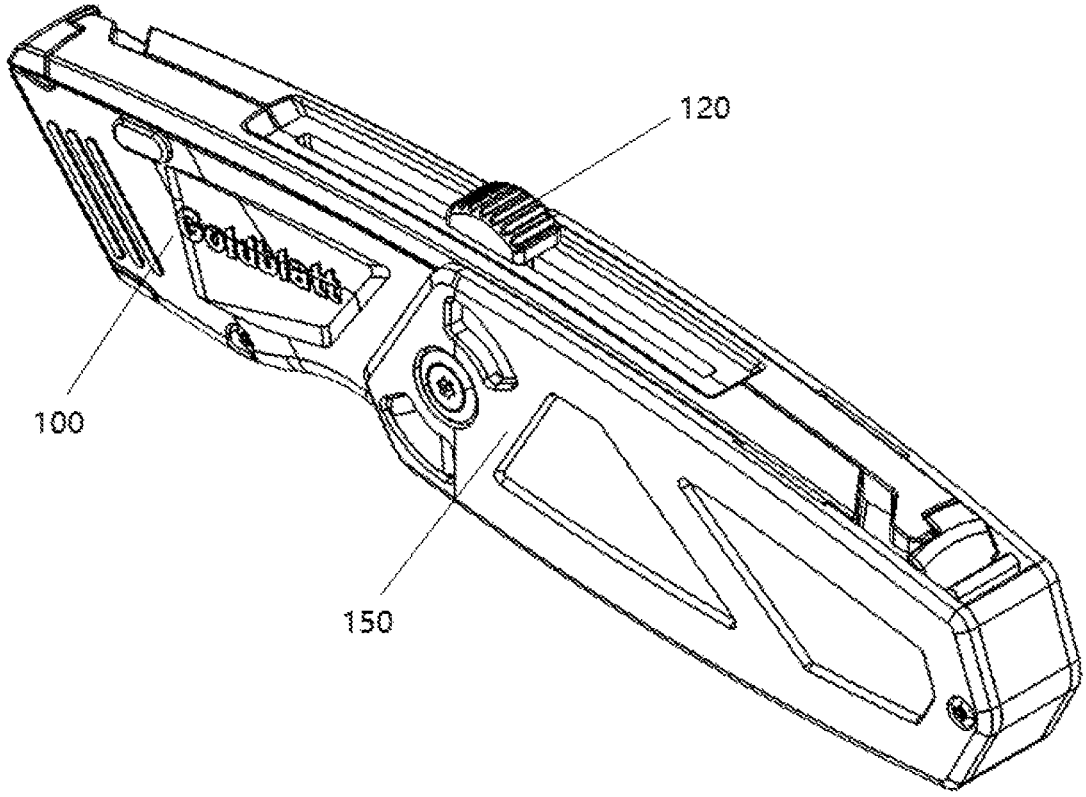
FIG. 12 is an external view of Embodiment 4 of a utility knife with dual blades according to the present utility model.
Figure 13:
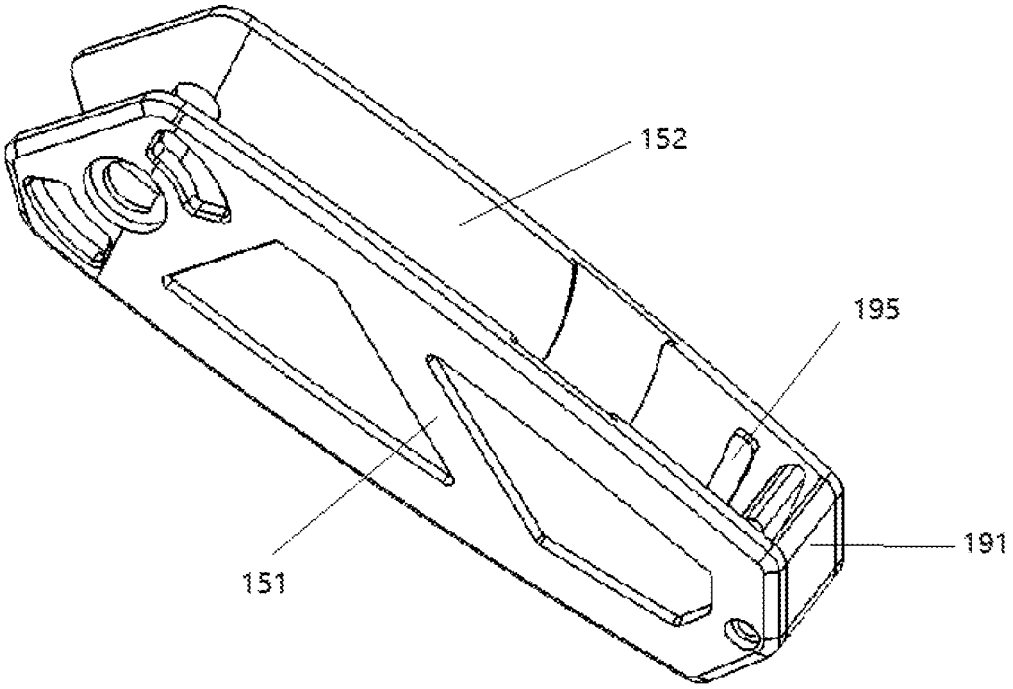
FIG. 13 is a perspective view of a movable member of Embodiment 4 of a utility knife with dual blades according to the present utility model.
Figure 14:
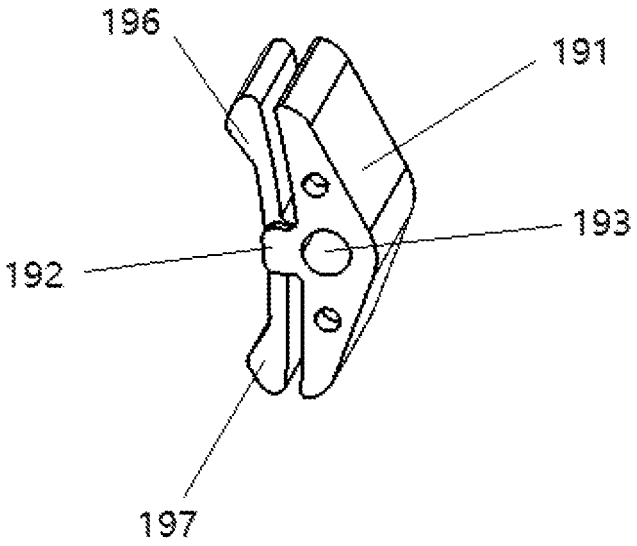
FIG. 14 is a perspective view of a structural body and an elastic structure of Embodiment 4 of a utility knife with dual blades according to the present utility model.
Figure 15:
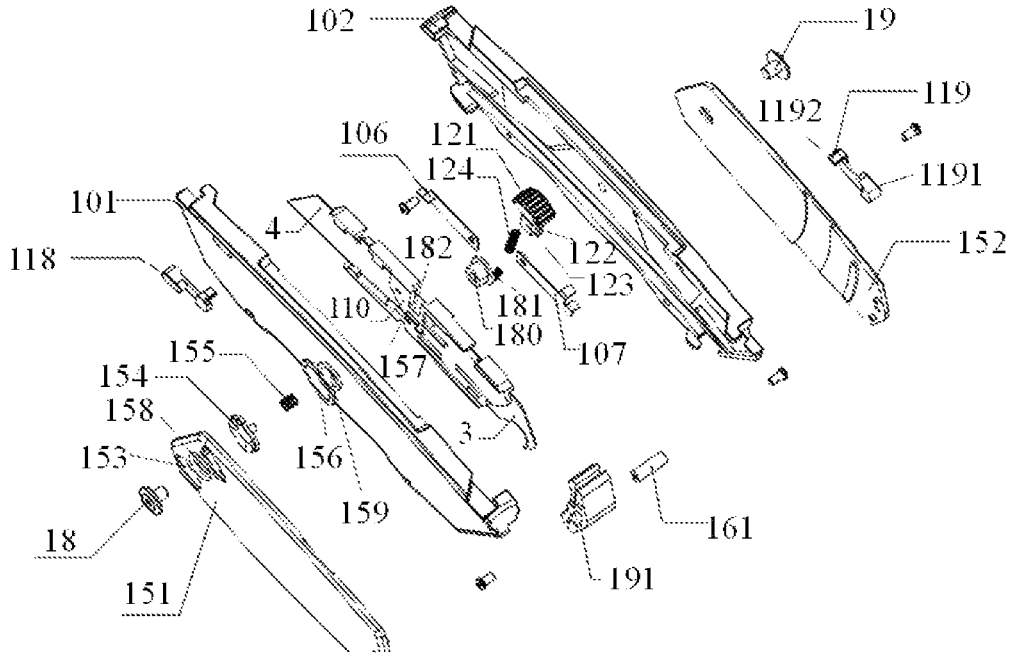
FIG. 15 is an exploded view of Embodiment 4 of a utility knife with dual blades according to the present utility model.
Figure 16:
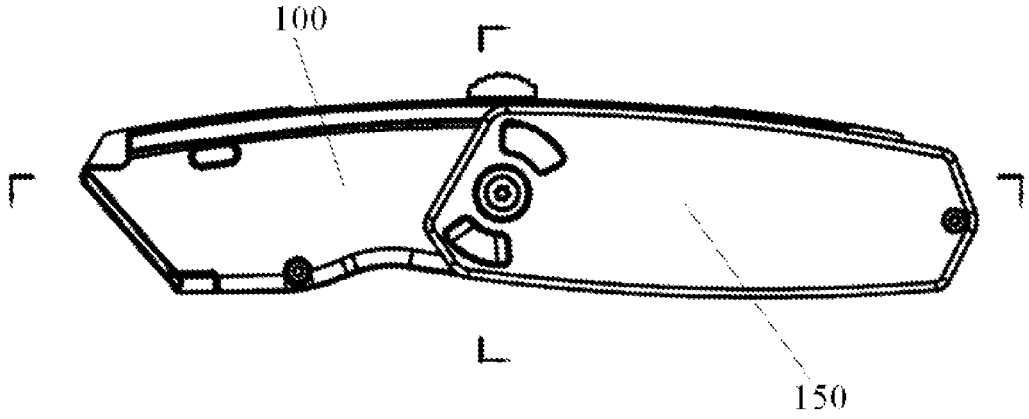
FIG. 16 is a front view of Embodiment 4 of a utility knife with dual blades according to the present utility model.
Figure 17:
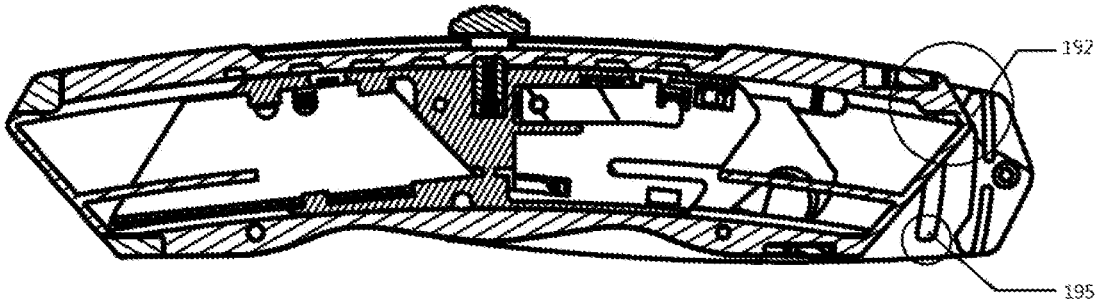
FIG. 17 is a side cross-sectional view of Embodiment 4 of a utility knife with dual blades according to the present utility model.
Figure 18:
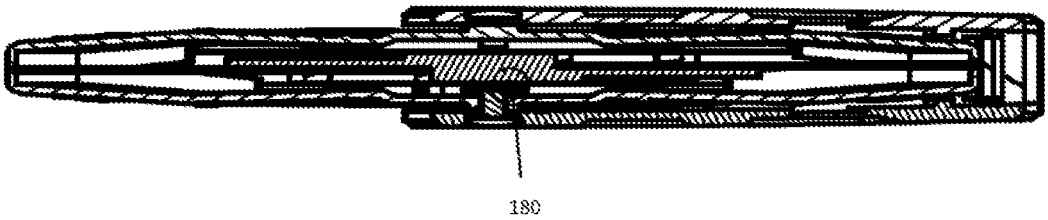
FIG. 18 is a transverse cross-sectional view of Embodiment 4 of a utility knife with dual blades according to the present utility model.
Figure 19:
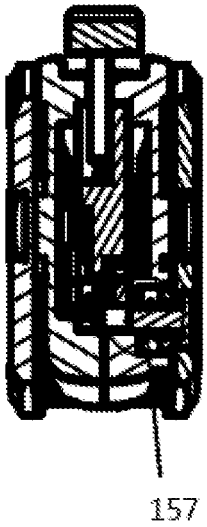
FIG. 19 is a cutaway cross-sectional view of Embodiment 4 of a utility knife with dual blades according to the present utility model.
Figure 20:
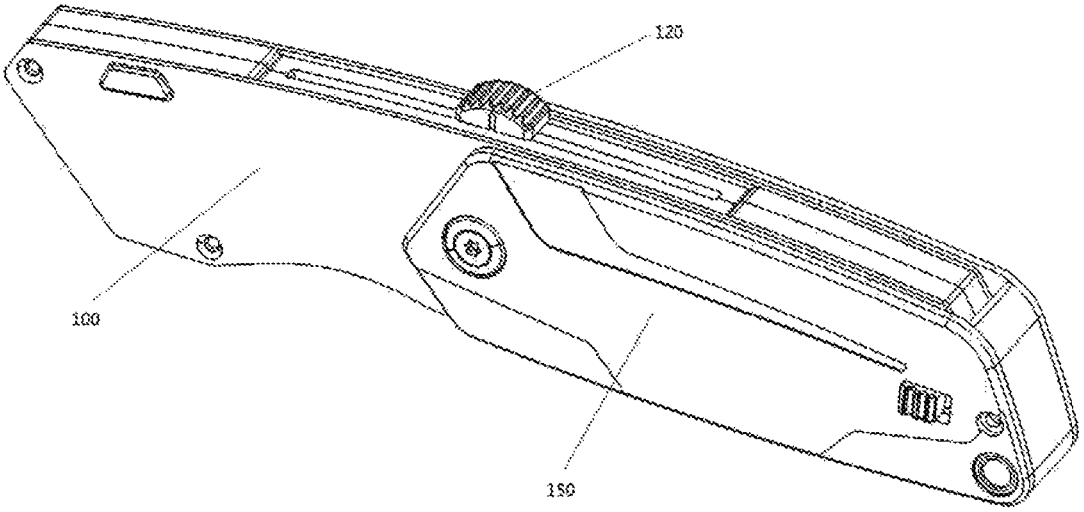
FIG. 20 is an external view of Embodiment 5 of a utility knife with dual blades according to the present utility model.
Figure 21:
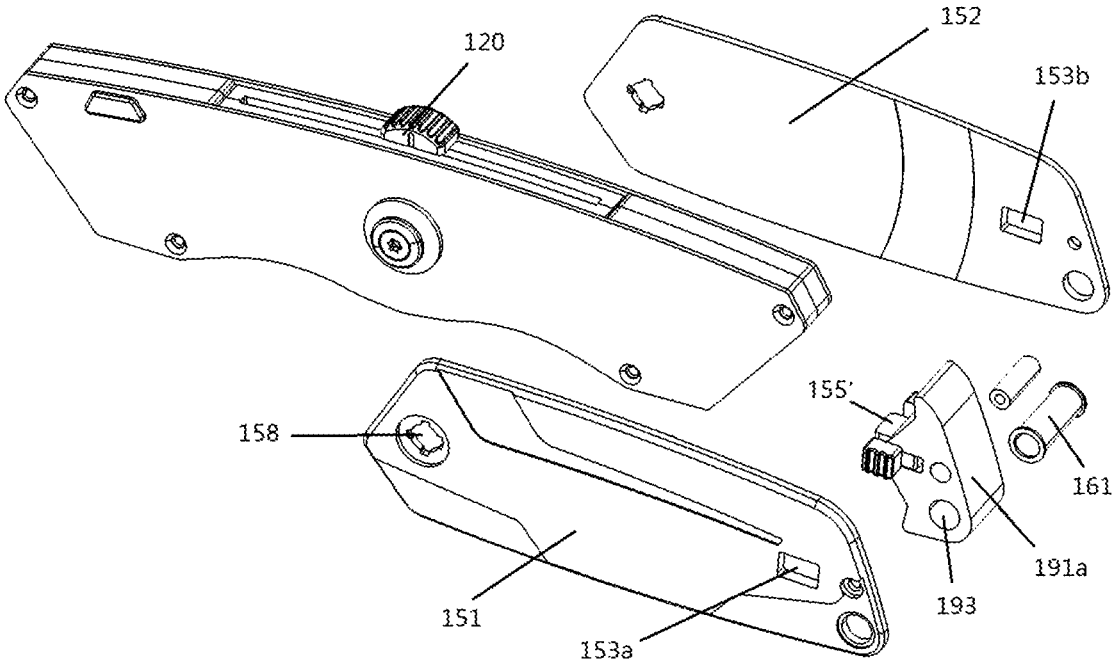
FIG. 21 is a first exploded view of Embodiment 5 of a utility knife with dual blades according to the present utility model.
Figure 22:
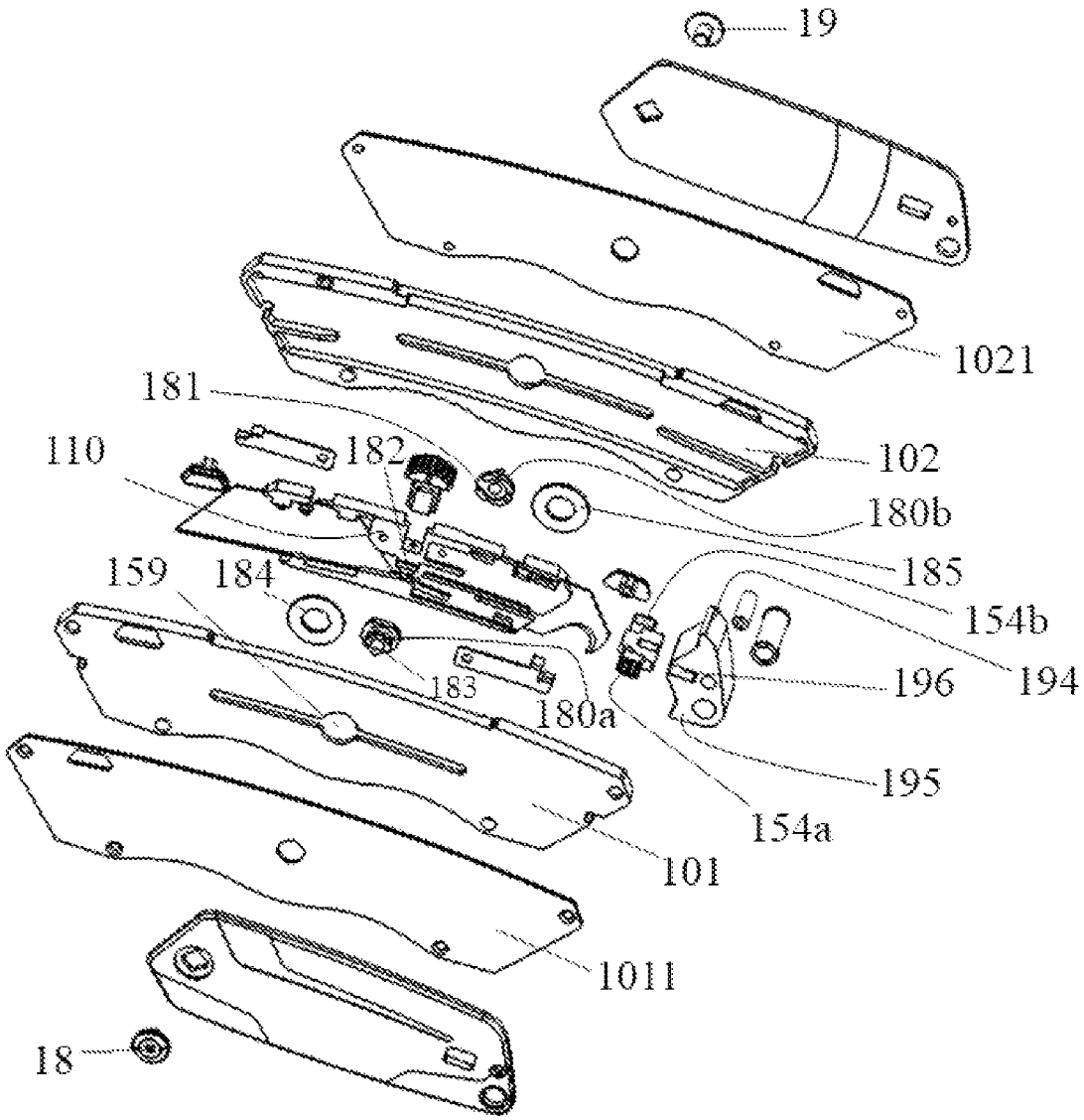
FIG. 22 is a second exploded view of Embodiment 5 of a utility knife with dual blades according to the present utility model.
Figure 23:
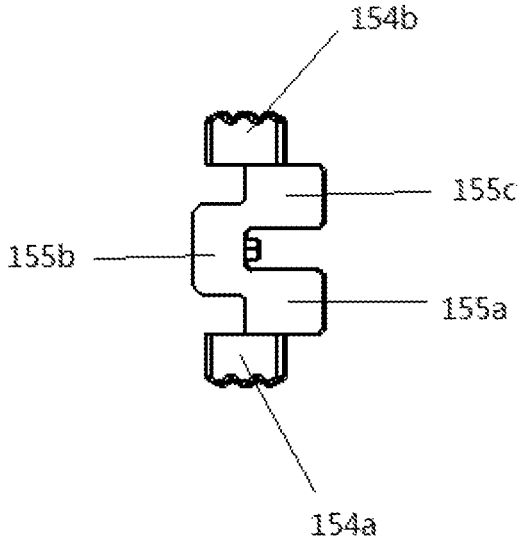
FIG. 23 is a schematic view of an elastic body of Embodiment 5 of a utility knife with dual blades according to the present utility model.

As shown in FIGS. 1-9, a utility knife with dual blades including a housing 100 having an opening at both ends, a blade carrier 110 which is mounted and is movable within the housing, a movement assembly 120 which is provided on the outside of the housing and is connected to the blade carrier for driving the blade carrier to move in a direction towards both ends of the housing, wherein the blade carrier is provided with an abutment portion 111, and the utility knife with dual blades according to the present utility model further includes a stop member 130, the stop member has a stop portion 131 which can change its position with respect to the abutment portion 111 so that the blade carrier 110 can be moved in a desired direction of a user. The blade carrier 110 can only be moved towards the first direction when the stop portion 131 is in a first position with respect to the abutment portion 111, and the blade carrier 110 can only be moved towards a second direction opposite to the first direction when the stop portion 131 is in the second position with respect to the abutment portion, so the moving direction is a single direction.

Specifically, the stop member 130 is provided in an intermediate position of the blade carrier 110. The position of the stop portion 131 of the stop member 130 can be varied between a first side of the abutment portion and a second side opposite to the first side, and when the stop portion 131 is on the first side of the abutment portion 111, the blade carrier 110 can only be moved in a direction towards the other side of the abutment portion 111, i.e., towards the second side, and when the stop portion 131 is on the second side of the abutment portion 111, the blade carrier 110 can only be moved in a direction towards the first side of the abutment portion 111. The utility knife with dual blades according to the present utility model further includes a trigger member 140 which is connected to the stop member and provided on the outside of the housing, and the trigger member 140 can drive the stop member 130 to move so that the position of the stop portion 131 can be varied between the first position and the second position on both sides of the abutment portion 111.

Specifically, the stop member 130 includes an annular body having a cutout 132 on the side, and the side wall of the annular body opposite to the cutout is the stop portion 131. The width of the cutout 132 is greater than that of the abutment portion 111, and the abutment portion can enter the inside of the annular body through the cutout. As such, when the stop portion is located on the first side of the abutment portion, the blade carrier can only move in a direction towards the other side of the abutment portion, that is, towards the second side, and when the stop portion 131 is on the second side of the abutment portion 111, the blade carrier 110 can only move in a direction towards the first side of the abutment portion. The abutment portion 111 is specifically a forwardly projecting boss in the intermediate position of the blade carrier. The annular body may be a ring-shaped columnar body, a rectangular annular body, or any other annular shape. The boss is cylindrical, elongated, or other shapes that can achieve the same purpose. For example, when the boss is cylindrical, the cylindrical boss may enter the inside of the ring-shaped columnar body through the cutout 132 and may be blocked inside the ring-shaped columnar body by the stop portion 131 on the side opposite to the cutout. When the annular body is a ring-shaped columnar body, the boss may be a rectangular boss as long as the boss may enter the inside of the annular body through the cutout and may be blocked by the stop portion.

The stop member 130 has a connecting portion 133 extending outwardly from one end of the annular body and connected to the trigger member 140 on the outside of the housing, and the trigger member 140 can drive the annular body to rotate so that the stop portion 131 of the stop member 130 may be moved to both sides of the abutment portion 111, respectively. The outer surface of the connecting portion has spaced flanges 134 and the inside of the trigger member has corresponding indentations 141 so that the trigger member 140 may be engaged with the connecting portion 133 of the stop member 130 for rotational movement. The connecting portion may also be provided with a rectangular shape and the inside of the trigger member may be provided with a corresponding shape so that the trigger member may be engaged with the connecting portion of the stop member for rotational movement. The outside of the trigger member is provides as a circular cover, and the outside portion of the cover has a texture for facilitating holding the cover of the trigger member by hand for rotation, thereby driving the stop member to rotate.

Further, the trigger member further includes a connecting member 142 which may be a screw having a rod portion and a head portion connected to the rod portion and having a larger cross section than the rod portion, there is a through hole in the center of the cover, the rod portion of the screw can pass through the through hole and the head portion is restricted outside of the through hole of the cover. The connecting portion 133 also has a connecting hole 135 inside which the screw may be accommodated and which may be engaged with the screw, so that the trigger member and the stop member are fixed to each other. Specifically, the outside of the screw has an external thread, and the inside of the connecting hole has an internal thread which matches the external thread of the screw, so that the trigger member and the stop member are relatively fixed. Further, the trigger member also has a moving direction identifier 143 indicating the direction in which the blade carrier may be moved, or that the blade or tool on that side may be extended in this moving direction.

The housing includes an upper housing 101 and a lower housing 102 which are connected via fasteners, and the blade carrier is movably mounted in the housing. Tracks are provided within the housing, and the blade carrier is provided on the tracks and may be moved along the tracks. The housing includes a first track 103 and a second track 104 which are the elongated projections provided on both sides of the housing, respectively, and the blade carrier is respectively provided with a first recess 112 and a second recess 113 which accommodate the elongated projections in the positions corresponding to the elongated projections, so that the blade carrier may be moved left and right along the elongated projections.

The movement assembly 120 is connected onto the blade carrier 110 and includes a manual portion 121 and a connecting body 122 connected to the manual portion, and the manual portion is provided outside of the housing for being easy to push by hand, and the connecting body 122 is connected onto the blade carrier 110 for driving the blade carrier to be moved. Specifically, the top of the manual portion has a texture for increasing the contact friction for being easy to push. The connecting body extends downwardly from the manual portion, and the blade carrier has a corresponding recess in the corresponding position so as to be engaged with the blade carrier to relatively fix the connecting body and the blade carrier, so that the manual portion can drive the blade carrier to move.

The blade carrier includes a first settling unit 114 and a second settling unit 115 which are respectively provided at both ends of the blade carrier 110, and a second blade 4 is mounted on the first settling unit 114, and a first blade 3 is mounted on the second settling unit 115. The second settling unit 115 has an upper resilient tab 116 and a lower projecting dam 117, the upper resilient tab 116 fixes the upper portion of the blade, and the lower dam 117 may stop the edge of the blade. Specifically, the upper resilient tab 116 is provided with a snap rim, and the blade is provided with a bayonet corresponding to the snap rim, so that the upper portion of the blade may be fixed. The first settling unit 114 may have the same arrangement, or may be provided with a different configuration for settling other tool. The blade carrier 110 further includes a first unlocking member 118 and a second unlocking member 119 which are provided in the first settling unit 114 and the second settling unit 115, respectively. Take the second unlocking member 119 for example, the second unlocking member 119 has a pressing portion 1191 and a projection structure 1192 connected to the pressing portion, and the projection structure 1192 can press the resilient tab 116 to enable the blade to be released from the snap rim of the resilient tab 116, so that the blade can be replaced for use.

The housing has a passage 105 in which the movement assembly 120 can be moved to move the blade carrier 110. The housing further includes a first stop unit 106 and a second stop unit 107 which are fixed onto the housing 100, respectively, and disposed in corresponding positions of the first settling unit 114 and the second settling unit 115. When the movement assembly 120 pushes the blade carrier 110 to the position of the first stop unit 106, the second blade 4 on the first settling unit 114 of the blade carrier 110 extends from the first port of the housing 100 and is in a state of use, and the first blade 3 is located within the housing 100. When the movement assembly 120 pushes the blade carrier 110 to the position of the second stop unit 107, the first blade 3 on the second settling unit 115 of the blade carrier 110 extends from the second port of the housing 100 and is in a state of use, and the second blade 4 is located within the housing 100. The first stop unit 106 and the second stop unit 107 are respectively provided at the front portion and the rear portion of the housing 100 and each have upwardly extending hooks 1061 and 1071 for stopping the continued movement of the blade carrier 110. The first blade 3 and the second blade 4 mounted on the blade carrier 110 are both received within the housing 100 when the movement assembly 120 is located in the intermediate position of the housing 100. The first blade 3 and the second blade 4 may be the same, and also may be different blades, or tools with any other function such as scissors, meeting different needs.

Further, the housing further has a first slot 1081, a second slot 108, and a third slot 1082 which respectively correspond to that the movement assembly 120 is in a first position, i.e., the corresponding position of the movement assembly 120 when the second blade 4 extends from the first port of the housing 100, the movement assembly 120 is in an intermediate position, i.e. the first blade 3 and the second blade 4 are both within the housing 100, and the movement assembly 120 is in the second position, i.e. the corresponding position of the movement assembly 120 when the first blade 3 extends from the second port of the housing 100. The bottom of the extension portion of the movement assembly 120 is also provided with a pocket within which a spring 124 is provided. In use, the spring 124 cooperates with the blade carrier 110 so that the movement assembly 120 can move up and down. The movement assembly 120 includes a manual portion 121 and an extension portion connected to the manual portion, the extension portion is connected to the blade carrier, and the extension portion also has a lateral shoulder 123. When the manual portion 121 is pressed, the projection of the extension portion can be snapped into the first slot 1081, the second slot 108 and the third slot 1082, having the effect of fixing temporarily.

Embodiment 2

As shown in FIGS. 1-10, a utility knife with dual blades including a housing 100 having an opening at both ends, a blade carrier 110 which is mounted and is movable within the housing 100, a movement assembly 120 which is provided on the outside of the housing 100 and is connected to the blade carrier 110 for driving the blade carrier 110 to move in a direction towards both ends of the housing 100, is characterized in that the blade carrier 110 is provided with an abutment portion 111, and the utility knife with dual blades according to the present utility model further includes a stop member 130*a*, and the stop member 130*a* has a stop portion, the position of the stop portion with respect to the abutment portion 111 may be varied so that the blade carrier 110 may be moved in a desired direction of a user. The blade carrier 110 can only be moved towards a first direction when the stop portion is in the first position with respect to the abutment portion 111, and the blade carrier 110 can only be moved towards a second direction opposite to the first direction when the stop portion is in the second position with respect to the abutment portion 111, so the moving direction is a single direction.

Specifically, the stop member 130*a* is provided in an intermediate position of the blade carrier 110. The position of the stop portion of the stop member 130*a* can be varied between a first side of the abutment portion 111 and a second side opposite to the first side, and when the stop portion is on the first side of the abutment portion 111, the blade carrier 110 can be only moved in a direction towards the other side of the abutment portion 111, i.e., the second side, and when the stop portion is on the second side of the abutment portion 111, the blade carrier 110 can be only moved in a direction towards the first side of the abutment portion 111. The utility knife with dual blades according to the present utility model further includes a trigger member 140 which is connected to the stop member 130*a* and is provided on the outside of the housing 100, and the trigger member 140 can drive the stop member 130*a* to move so that the position of the stop portion 131*a* can be varied between the first position and the second position on both sides of the abutment portion 111.

Specifically, the stop member 130*a* includes a bump 131*a* which can block the abutment portion 111 of the blade carrier 110. As such, when the bump 131*a* is on the first side of the abutment portion 111, the blade carrier 110 can be only moved in a direction towards the other side of the abutment portion 111, i.e., the second side, and when the bump 131*a* is on the second side of the abutment portion 111, the blade carrier 110 can be only moved in a direction towards the first side of the abutment portion 111. The abutment portion 111 is specifically a forwardly projecting boss in the intermediate position of the blade carrier 110. The boss is cylindrical, elongated, or other shapes that can achieve the same purpose.

The stop member 130*a* has a connecting portion extending outwardly from one end of the bump 131*a* and connected to the trigger member 140 on the outside of the housing 100, and the trigger member 140 can drive the bump 131*a* to rotate so that the bump 131*a* of the stop member 130*a* may be moved to both sides of the abutment portion 111, respectively. The outer surface of the connecting portion has spaced flanges and the inside of the trigger member 140 has corresponding indentations so that the trigger member 140 may be engaged with the connecting portion of the stop member 130*a* for rotational movement. The connecting portion may also be provided with a rectangular shape and the inside of the trigger member 140 may be provided with a corresponding shape so that the trigger member 140 may be engaged with the connecting portion of the stop member 130*a* for rotational movement. The outside of the trigger member 140 is provided as a circular cover, and the outside portion of the cover has a texture for facilitating holding the cover of the trigger member 140 by hand for rotation, thereby driving the stop member 130*a* to rotate.

Further, the trigger member 140 further includes a connecting member 142 including a screw having a rod portion and a head portion connected to the rod portion and having a larger cross section than the rod portion, there is a through hole in the center of the cover, the rod portion of the screw can pass through the through hole and the head portion is restricted outside of the through hole of the cover. The connecting portion also has a connecting hole inside which the screw may be accommodated and which may be engaged with the screw, so that the trigger member 140 and the stop member 130*a* are fixed to each other. Specifically, the outside of the screw has an external thread, and the inside of the connecting hole has an internal thread which matches the external thread of the screw, so that the trigger member 140 and the stop member 130*a* are relatively fixed. Further, the trigger member 140 also has a moving direction identifier 143 indicating that the blade or tool on that side may be extended in this moving direction.

The other parts of this embodiment may be the same as those of Embodiment 1, and also may be provided in other ways, which are all within the scope of the claims of the present utility model.

Embodiment 3

As shown in FIGS. 1-11, a utility knife with dual blades including a housing 100 having an opening at both ends, a blade carrier 110 which is mounted and is movable within the housing 100, and a movement assembly 120 which is provided on the outside of the housing 100 and is connected to the blade carrier 110 for driving the blade carrier 110 to move in a direction towards both ends of the housing 100, is characterized in that the blade carrier 110 is provided with an abutment portion 111 and further includes a stop member 130*b*, and the relative position of the stop member 130*b* with respect to the abutment portion 111 may be varied, and the stop member 130*b* can stop the abutment portion 111 when the stop member 130*b* is in the first position, i.e., the stop position, so that the blade carrier 110 cannot be moved; and the stop member 130*b* cannot stop the abutment portion 111 when the stop member 130*b* is in the second position, i.e., in the unstopped position, so that the blade carrier 110 can be moved.

The utility knife with dual blades according to the present utility model further includes a trigger member 140 which is connected to the stop member 130*b* and is provided on the outside of the housing 100, and the trigger member 140 can drive the stop member 130*b* to move so that the position of the stop portion may be varied between the first position and the second position on both sides of the abutment portion 111.

Specifically, the abutment portion 111 is specifically a front boss in the intermediate position of the blade carrier 110. The stop member 130*b* is a hollow body, such as a hollow columnar body or other hollow shapes. The trigger member 140 is a pushing element connected to the stop member 130*b*, which can push the stop member 130*b* to move back and forth. The front boss of the abutment portion 111 is restricted within the hollow body of the stop member 130*b* when the stop member 130*b* is in the first position, i.e., the stop position, so that it cannot be moved to push the blade out. The stop member 130*b* is moved rearwardly along with the pushing portion after the pushing element is pressed so that the stop member 130*b* is disengaged from the abutment portion 111 and is moved to the second position, i.e., an unstopped position, so that the blade carrier 110 can be moved to push the blade out towards either end of the housing 100.

The other parts of this embodiment may be the same as those of Embodiment 1, and also may be provided in other ways, which are within the scope of the claims of the present utility model.

Embodiment 4

As shown in FIGS. 12-19, and in conjunction with other related figures, a utility knife with dual blades includes a housing 100 having a first end and a second end; a blade carrier 110 for respectively carrying two blades at both ends, which is mounted and is movable within the housing 100 so that the blades can extend from either of the first end and the second end of the housing; and a movable member 150 for movably moving to the other end opposite to either of the first end or the second end so as to block the blade from extending from the other end opposite to either of the first end or the second end. One end of the movable member 150 is connected to the intermediate portion of the housing 100 via a shaft and the other end is rotatable about the shaft so as to be movable to both ends of the housing 100, i.e., the first end or the second end, respectively.

The utility knife with dual blades according to this embodiment further includes a movement assembly 120 provided on the outside of the housing and connected to the blade carrier 110 for driving the blade carrier 110 to move in a direction towards the first end or the second end of the housing 100.

The housing 100 includes an upper housing 101 located on the upper side and a lower housing 102 located on the lower side. The movable member 150 includes a first movable member 151 and a second movable member 152 which are located on both sides of the housing 100, respectively. The first movable member 151 is connected to the upper housing 101 via a first shaft 18 and the second movable member 152 is connected to the lower housing 102 via a second shaft 19, and the first shaft 18 and the second shaft 19 may be two portions at both ends of an integral shaft or may be two separate shafts at both ends of one axis so that the movable member 150 is rotatable about the housing 100 to be movable to both ends of the housing 100, i.e., the first end or the second end, respectively. The first shaft 18 and the second shaft 19 are specifically, for example, screw head nails, a first movable member 151 and a second movable member 152 and the upper housing 101 and the lower housing 102 have through-holes; the first shaft, i.e., the screw head nail as shown, connects the first movable member 151 with the upper housing 101 through the handle hole 158 in the first movable member 151 and the housing hole 159 in the upper housing 101, and the second shaft 19 connects the second movable member 152 with the lower housing 102 through the through holes in the second movable member 152 and the lower housing 102.

The movable member 150 further includes a through hole 153 located at the end of the movable member adjacent to the shaft and a button 154 located within the through hole; for example, in the first movable member 151, and in this embodiment, the through hole 153 is a dome shape or circular in the figures, or any other shapes. The movable member 150 further includes an elastic member 155 connected to the rear portion of the button 154, as such, when the button 154 is pressed, the button 154 can be pressed out of the through hole 153 of the movable member 150 to move to outside the inner side of the movable member 150. As such, normally, the button 154 is located inside the through hole 153, the movable member 150 cannot move; when the button 154 is pressed, the button 154 is pressed out of the through hole 153 of the movable member 150 so that the movable member 150 can move around the shaft, and can move to the two sides of the housing, respectively.

Further, the button hole 156 is provided in a position corresponding to the button 154 on the upper housing 101, and the button 154 can be accommodated therein so as not to block the movement of the movable member 150 about the shaft when the button 154 is pressed. The elastic member 155 is engaged with the blade carrier 110 through the button hole 156 in the upper housing 101, and the elastic member 155 such as a spring bounces the button back into the inside of the through hole 153 within the first movable member 151 when the button 154 is released, so as to block the movable member 150 to continue to move and fix the movable member 150.

Specifically, when the blade carrier 110 is in the intermediate position, a groove 157 is provided in a position corresponding to the button hole 156 of the upper housing 101 on the blade carrier 110, and the groove 157 is engaged with the button 154 and the elastic member 155 such as a spring; and only when the blade carrier 110 is in the intermediate position, the elastic member 155 may be engaged with the groove 157 through the button hole 156 so that the elastic member 155 may be compressed within the groove 157. At this time, the button 154 can be further inserted into the button hole 156 of the upper housing 101 when the button 154 is pressed so that the movable member can rotate about the shaft, and the blade carrier 110 cannot be moved since the groove 157 is fixed to the elastic member 155 are when the button 154 is pressed, i.e., the effect to be achieved is, the blade carrier 110 cannot be moved left and right when the movable member can move, so that the utility knife with dual blades according to the present utility model is very safe to use; the button 154 cannot be pressed because the groove 157 is not in the intermediate position of the housing 100 when the blade carrier 110 is on either side, that is, when the blade is extended, so that the movable member cannot move.

Further, the utility knife with dual blades according to the present utility model further includes a rotating member 180 located between the housing 100 and the blade carrier 110, which is connected to the first shaft 18 or the second shaft 19 of the movable member 150, for example, which is connected to the first shaft 18, and is rotatable with the rotation of the movable member 150, and the rotating member 180 is provided with a blocking portion 181 located at the side of one end of the rotating member 180, and when the movable member 150 rotates to one end of the housing 100, the blocking portion 181 is rotated on the rotating member 180 to a side adjacent to the movable member 150 along with a first shaft 18 of the movable member 150, so as to block the blade carrier 110 to move towards the end at which the movable member 150 is located. As such, when the blade carrier 110 is in the intermediate position of the housing 100, the blocking portion 181 of the rotating member 180 may block the blade carrier 110 and prevent the blade carrier 110 from moving towards the side on which the movable member 150 is located, as such, the blade on the side on which the movable member 150 is located will not come out, having the effect of security. The forwardly projecting boss 182 is provided in the intermediate position of the blade carrier 110, and the blocking portion 181 is on the side of the boss 182 on which the movable member 150 is located when the movable member 150 rotates to one end of the housing 100, so that the blocking portion 181 can prevent movement of the boss 182 on the blade carrier 110 towards one end at which the movable member 150 is located. There may be two rotating members 180 which are respectively provided on both sides of the blade carrier 110, and the blade carrier 110 are respectively provided on both sides thereof with bosses 182 which may interfere with the rotating members 180 provided on both sides of the blade carrier 110. The two rotating members 180 are respectively connected to the first shaft 18 and the second shaft 19 to rotate with the rotation of the first shaft 18 and the second shaft 19, so as to change the relative direction between the blocking portion 181 on the rotating member 180 and the boss 182 on the blade carrier 110. Specifically, the other ends of the two rotating members 180 respectively have connecting bodies which are respectively connected to the inwardly end of the screw head nails as the first shaft 18 or the second shaft 19 so that the rotating member 180 can rotate with the shaft. Specifically, the connecting body has a connecting hole inside which one end of the screw head nail may be accommodated to form a connection.

The movable member 150 composed of the first movable member 151 and the second movable member 152 fits the sizes of the left and right portions of the housing 100, respectively, and the left and right portions of the housing 100 can be accommodated between the first movable member 151 and the second movable member 152, respectively. The first movable member 151 and the second movable member 152 of the movable member 150 are connected to the housing 100 via the shaft on one end and the first movable member 151 and the second movable member 152 are fixed to each other via a pin 161 on the other end.

Further, the rear portion of the movable member 150 is provided with a structural body 191 and an elastic structure 192 connected to the structural body 191, and the structural body 191 has a pin hole 193 in the center thereof, and the pin 161 is connected to the first movable member 151 and the second movable member 152 of the movable member 150 through the pin hole 193. The structural body 191 is fixedly connected to the first movable member 151 and the second movable member 152 via two bolts respectively on both sides of the pin hole 193 in the center thereof, respectively, so that the structural body 191 is fixedly connected to the movable member 150.

The elastic structure 192 is fixedly connected or integrally extended in the intermediate position of the structural body 191. The elastic structure 192 includes two fins 196 and 197 which respectively extend towards the two sides from the intermediate position and project inwardly at the ends and which may be hook-shaped. When the movable member 150 moves to one end of the housing 100, the fins of the elastic structure 192 is bounced and pressed, so that the housing 100 may be fixed within the movable member 150 to prevent the movable member 150 from fluctuating up and down. Further, the first movable member 151 and the second movable member 152 are provided with ribs 195 which may be engaged with the housing 100 to prevent the movable member 150 from fluctuating up and down.

The housing 100 includes an upper housing 101 and a lower housing 102 which are connected via fasteners, and the blade carrier 110 is movably mounted on the housing 100. Tracks are provided within the housing 100, and the blade carrier 110 is provided on the tracks and may be moved along the tracks. The housing includes a first track 103 and a second track 104 which are the elongated projections provided on both sides of the housing 100, respectively, and the blade carrier 110 is respectively provided with a first recess 112 and a second recess 113 which accommodate the elongated projections in the positions corresponding to the elongated projections, so that the blade carrier 110 may be moved left and right along the elongated projections.

The movement assembly 120 is connected onto the blade carrier 110 and includes a manual portion 121 and a connecting body 122 connected to the manual portion 121, and the manual portion 121 is provided outside of the housing 100 for being easy to push by hand, and the connecting body 122 is connected onto the blade carrier 110 for driving the blade carrier 110 to be moved. Specifically, the top of the manual portion 121 has a texture for increasing the contact friction for being easy to push. The connecting body 122 extends downwardly from the manual portion 121, and the blade carrier 110 has a corresponding recess in the corresponding position so as to be engaged with the blade carrier 110 to relatively fix the connecting body 122 and the blade carrier 110, so that the manual portion 121 can drive the blade carrier 110 to move.

The other parts of this embodiment may be the same as those of Embodiment 1, and may be provided in other ways.

Embodiment 5

As shown in FIGS. 20-23, and in conjunction with other related figures, a utility knife with dual blades includes a housing 100 having a first end and a second end; a blade carrier 110 for respectively carrying two blades at both ends, which is mounted and is movable within the housing 100 so that the blades can extend from either of the first end and the second end of the housing 100; and a movable member 150 for movably moving to the other end opposite to either of the first end or the second end so as to block the blades extending from the other end opposite to either of the first end or the second end. One end of the movable member 150 is connected to the intermediate portion of the housing 100 via a shaft and the other end is rotatable about the shaft so as to be movable to the first end and the second end of the housing 100, respectively.

The utility knife with dual blades of this embodiment further includes a movement assembly 120 provided on the outside of the housing 100 and connected to the blade carrier 110 for driving the blade carrier 110 to move in a direction towards the first end or the second end of the housing 100, respectively.

The housing 100 includes an upper housing 101 located on the upper side and a lower housing 102 located on the lower side. The movable member 150 includes a first movable member 151 and a second movable member 152 which are located on both sides of the housing 100, respectively. The first movable member 151 is connected to the upper housing 101 via a first shaft 18 and the second movable member is connected to the lower housing 102 via a second shaft 19, and the first shaft 18 and the second shaft 19 may be two portions at both ends of an integral shaft or may be two separate shafts at both ends of one axis, so that the movable member 150 can rotate about the housing 100 to be able to move to both ends of the housing 100, i.e., the first end or the second end, respectively. The first shaft 18 and the second shaft 19 are specifically, for example, screw head nails as shown, a first movable member 151 and a second movable member 152 and the upper housing 101 and the lower housing 102 have through-holes, the first shaft 18, i.e., the screw head nail as shown, connects the first movable member 151 with the upper housing 101 through the handle hole 158 in the first movable member 151 and the housing hole 159 in the upper housing 101, and the second shaft 19 connects the second movable member 152 with the lower housing 102 through the housing holes in the second movable member 152 and in the lower housing 102.

The movable member 150 further includes a through hole located at the end of the movable member 150 adjacent to the end of the housing 100 and a button located in the through hole, and in this embodiment, the through hole is rectangular as shown, and it may also be a dome shape or circular or other shapes. The movable member 150 further includes an elastic body 155' connected to the rear portion of the button, as such, when the button is pressed, the button can be pressed out of the through hole of the movable member 150 to move to outside the inner side of the movable member 150. As such, normally, the button is located inside the through hole, the movable member 150 cannot move; when the button is pressed, the button is pressed out of the through hole of the movable member 150 so that the movable member can move about the shaft and can move to both sides of the housing 100, respectively.

In this specific embodiment, the first movable member 151 and the second movable member 152 of the movable member 150 have a first through hole 153*a*, a first button 154*a* and a second through hole 153*b*, a second button 154*b* in positions adjacent to the ends, respectively, and the first button 154*a* is located in the first through hole 153*a* and the second button 154*b* is located in the second through hole 153*b*. When two fingers are used on both sides of the movable member 150, i.e., on the first button 154*a* and the second button 154*b* of the first movable member 151 and the second movable member 152, the two fingers press the buttons at the same time when in use, and the two buttons are simultaneously pressed out of the movable member 150, so that the movable member 150 can move about the shaft, and can move to both sides of the housing 100, respectively.

The first button 154*a* and the second button 154*b* are connected via the elastic body 155', and may be formed integrally with the elastic body 155'. The elastic body 155' can support the first button 154*a* and the second button 154*b* and simultaneously compress them into the first movable member 151 and the second movable member 152. The elastic body 155' is connected in the first button 154*a* and the second button 154*b*, and is a curved shape so that it can be compressed. Specifically, it may be S-shaped, hill-shaped, and the like. In this specific embodiment, the elastic body 155' includes a first portion 155*a*, a second portion 155*b* and a third portion 155*c*, the first portion 155*a* and the third portion 155*c* are connected to the first button 154*a* and the second button 154*b*, respectively, have a void therebetween and extend towards the same side, and the second portion 155*b* is located between the first portion 155*a* and the third portion 155*c*, both ends of which are connected to the first portion 155*a* and the third portion 155*c*, respectively, is above the void and extends towards the opposite side. The position of the elastic body 155' is outside the end of the housing 100 and does not interfere with the housing 100. Openings may also be formed on the housing 100 and the blade carrier 110, leaving room for the elastic body 155'. The material of the elastic body 155' can be plastic, perspex, resin and so on.

Further, the utility knife with dual blades according to the present utility model further includes a rotating member 180 located between the housing 100 and the blade carrier 110, which is connected to the first shaft 18 or the second shaft 19 of the movable member 150, for example, which is connected to the first shaft 18, and is rotatable with the rotation of the movable member 150, and the rotating member 180 is provided with a blocking portion 181 located at the side of one end of the rotating member 180, and when the movable member 150 rotates to one end of the housing 100, the blocking portion 181 is rotated on the rotating member 180 to a side adjacent to the movable member 150 along with a first shaft 18 of the movable member 150, so as to block the blade carrier 110 to move towards the end at which the movable member 150 is located. As such, when the blade carrier 110 is in the intermediate position of the housing 100, the blocking portion 181 of the rotating member 180 may block the blade carrier 110 and prevent the blade carrier 110 from moving towards the side on which the movable member 150 is located, as such, the blade on the side on which the movable member 150 is located will not come out, having the effect of security. The forwardly projecting boss 182 is provided in the intermediate position of the blade carrier 110, and the blocking portion 181 is on the side of the boss 182 on which the movable member 150 is located when the movable member 150 rotates to one end of the housing 100, so that the blocking portion 181 can prevent movement of the boss 182 on the blade carrier 110 towards one end at which the movable member 150 is located. There may be two rotating members 180 which are respectively provided on both sides of the blade carrier 110, and the blade carrier 110 are respectively provided on both sides thereof with bosses 182 which may interfere with the rotating members 180 provided on both sides of the blade carrier 110. The two rotating members are respectively connected to the first shaft 18 and the second shaft 19 to rotate with the rotation of the first shaft 18 and the second shaft 19, so as to change the relative direction between the blocking portion 181 on the rotating member 180 and the boss 182 on the blade carrier 110. Specifically, the other ends of the two rotating members respectively have connecting bodies 183 which are respectively connected to the inwardly end of the screw head nails as the first shaft 18 or the second shaft 19 so that the rotating member 180 can rotate with the shaft. Specifically, the connecting body has a connecting hole inside which one end of the screw head nail may be accommodated to form a connection.

Specifically, the utility knife with dual blades according to the present utility model includes a first rotating member 180*a* and a second rotating member 180*b* which are respectively located on both sides of the blade carrier 110 and respectively connected to the first shaft 18 and the second shaft 19. The two rotating members 180*a*, 180*b* have the same structural features and functions as described above. The housing hole 159 also has elongated slots on both sides so that the blade carrier 110 can move freely with respect to the housing 100 along with the movement assembly 120 without interfering the connection of the first shaft 18 or the second shaft 19 with the blade carrier 110.

Further, a structural body 191*a* is provided at the rear portion of the movable member 150, the structural body 191*a* has a pin hole 193 in the center thereof, and the pin 161 is connected to the first movable member 151 and the second movable member 152 of the movable member 150 through the pin hole 193. The structural body 191*a* is fixedly connected to the first movable member 151 and the second movable member 152 respectively through the pin hole 193 via a bolt so as to fixedly connect the structural body 191*a* to the movable member 150.

The structural body 191*a* has inwardly protrusions 194 and 195 in the upper and lower portions, and the housing 100 can be restricted within the movable member 150 to prevent the movable member 150 from fluctuating up and down. The inwardly side of the rib also has a trench 196 which can accommodate a portion of the elastic body without blocking the elastic body.

The present utility model further includes a gasket located between the rotating member and the housing, and a protective layer between the housing 100 and the movable member 150. A first gasket 184 is provided between the first rotating member 151 and the first housing 101, and a second gasket 185 is provided between the second rotating member 152 and the second housing 102; there is a first protective layer 1011 between the first housing 100 and the first movable member 151, and there is a second protective layer 1021 between the second housing 102 and the second movable member 152. The first protective layer 1011 and the second protective layer 1021 have holes in the positions of the first shaft 18 and the second shaft 19, respectively, so that the first shaft 18 and the second shaft 19 can pass through them without affecting the function of the present utility model.

The other parts of the present utility model refer to Embodiment 1 and Embodiment 4 or other embodiments, and may be provided in the same or different ways with Embodiment 1 and Embodiment 4 or other embodiments, which are within the scope of the present utility model.

Embodiment 6

Figure 24:
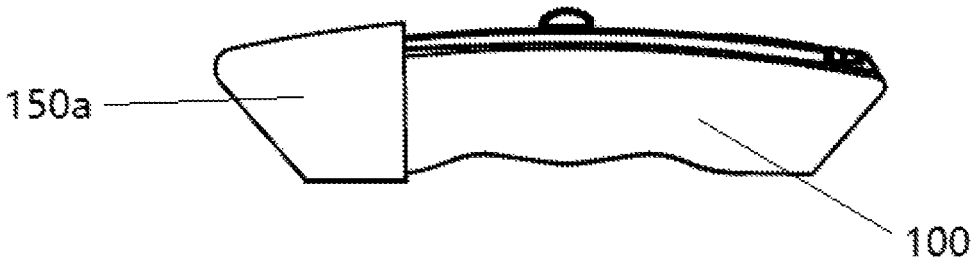
FIG. 24 is an external view of Embodiment 6 of a utility knife with dual blades according to the present utility model.
Figure 25:
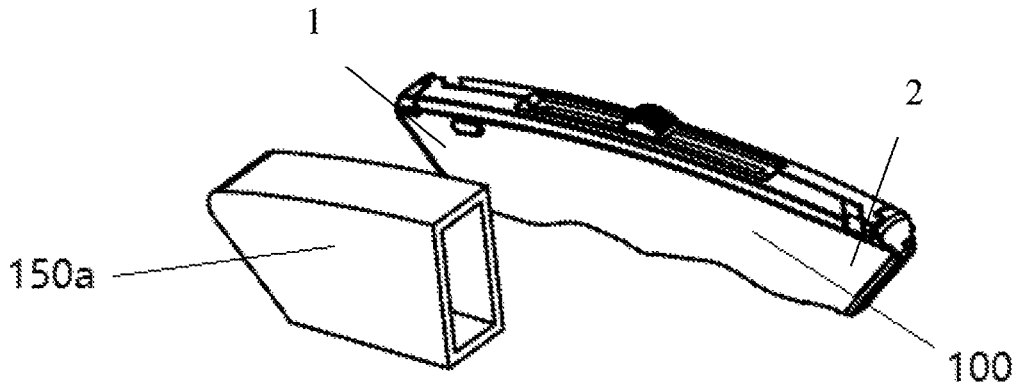
FIG. 25 is an exploded view of Embodiment 6 of a utility knife with dual blades according to the present utility model.

Referring to FIGS. 24 and 25, and other related figures, a utility knife with dual blades is characterized in that it includes a housing 100 having a first end 1 and a second end 2; a blade carrier for carrying two blades at both ends, respectively, which is mounted and is movable within the housing to enable the blade to extend from either of the first end and the second end of the housing; and a movable member 150 for movably moving to the other end opposite to either of the first end or the second end so as to block the blade from extending from the other end opposite to either of the first end or the second end. The movable member includes a sheath 150*a* for fitting over the edge of the first end or the second end. The utility knife with dual knife according to the present utility model includes a first blade 3 and a second blade 4 which are respectively mounted at both ends of the blade carrier and can respectively extend from the first end and the second end of the housing, the first blade 3 and the second blade 4 may be the same or different, and the other parts may be the same as those of Embodiment 4 or Embodiment 5.

Embodiment 7

Figure 26:
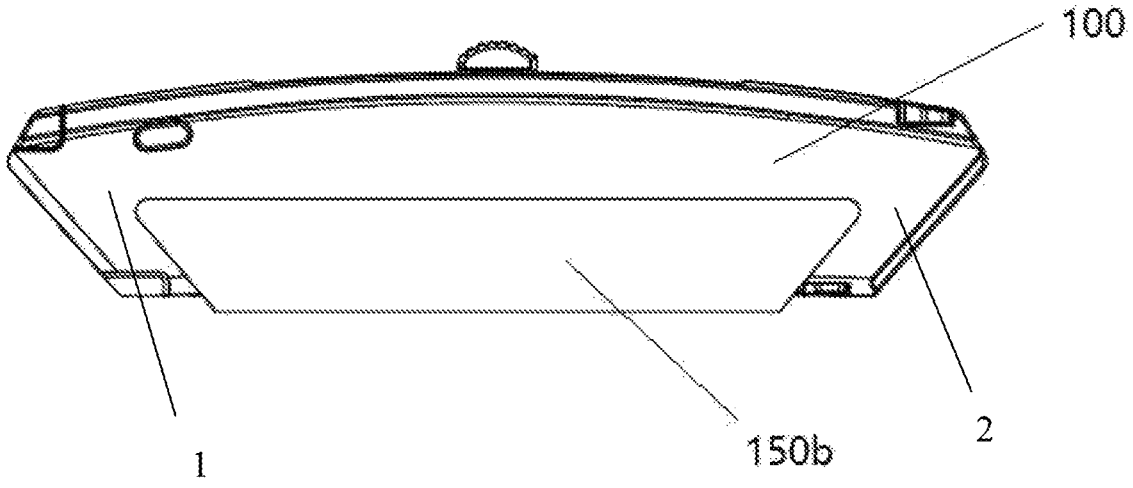
FIG. 26 is an external view of Embodiment 7 of a utility knife with dual blades according to the present utility model.
Figure 27:
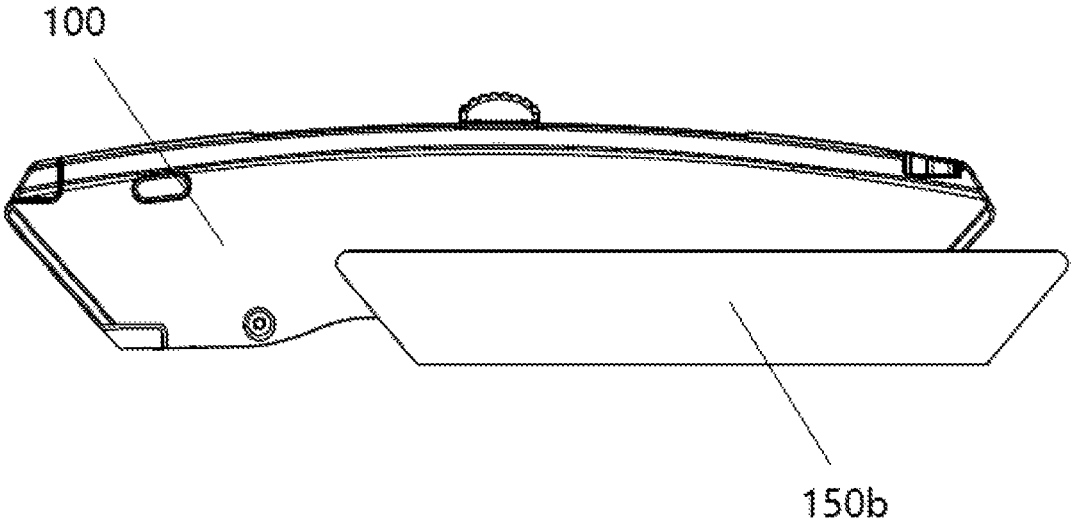
FIG. 27 is an exploded view of Embodiment 7 of a utility knife with dual blades according to the present utility model.

Referring to FIGS. 26 and 27 and other related figures, a utility knife with dual blades is characterized in that it includes a housing 100 having a first end 1 and a second end 2; a blade carrier 110 for carrying two blades at both ends, respectively, which is mounted and is movable within the housing 100 to enable the blade to extend from either of the first end and the second end of the housing 100; and a movable member 150*b* for movably moving to the other end opposite to either of the first end 1 or the second end 2 so as to block the blade from extending from the other end opposite to either of the first end 1 or the second end 2. The movable member 150*b* is translatably mounted on the housing 100 for moving along the housing 100 to the first end 1 or the second end 2, respectively, and the movable member 150*b* has movable guards on both sides for guarding at the outer edges of the first end 1 and the second end 2. The guards are foldably connected to the edge of one end of the movable member 150*b*. The utility knife with dual blades according to the present utility model includes a first blade 3 and a second blade 4 which are respectively mounted at both ends of the blade carrier 110 and can respectively extend from the first end 1 and the second end 2 of the housing 100, the first blade 3 and the second blade 4 may be the same or different, and the other parts is the same as those of Embodiment 4 or Embodiment 5.

Embodiment 8

Figure 28:
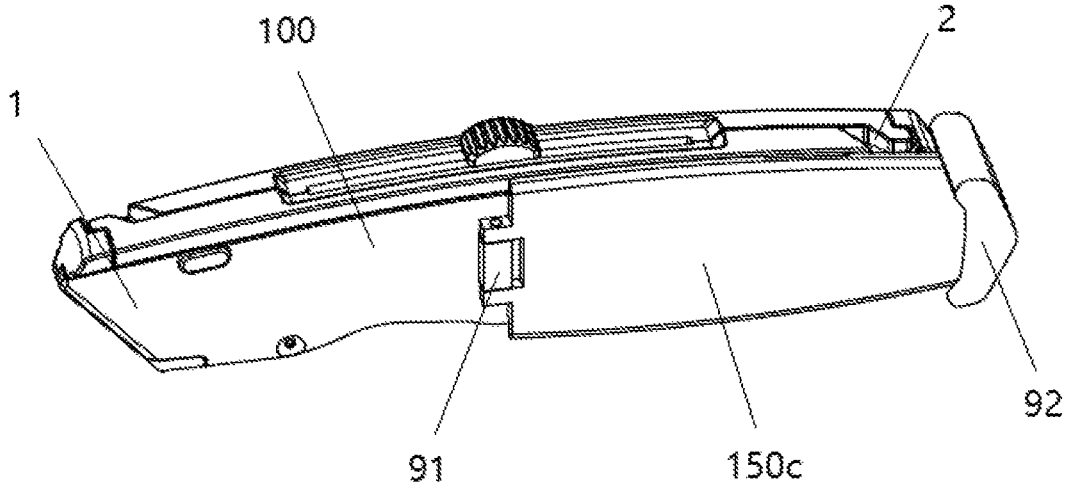
FIG. 28 is an external view of Embodiment 8 of a utility knife with dual blades according to the present utility model.
Figure 29:
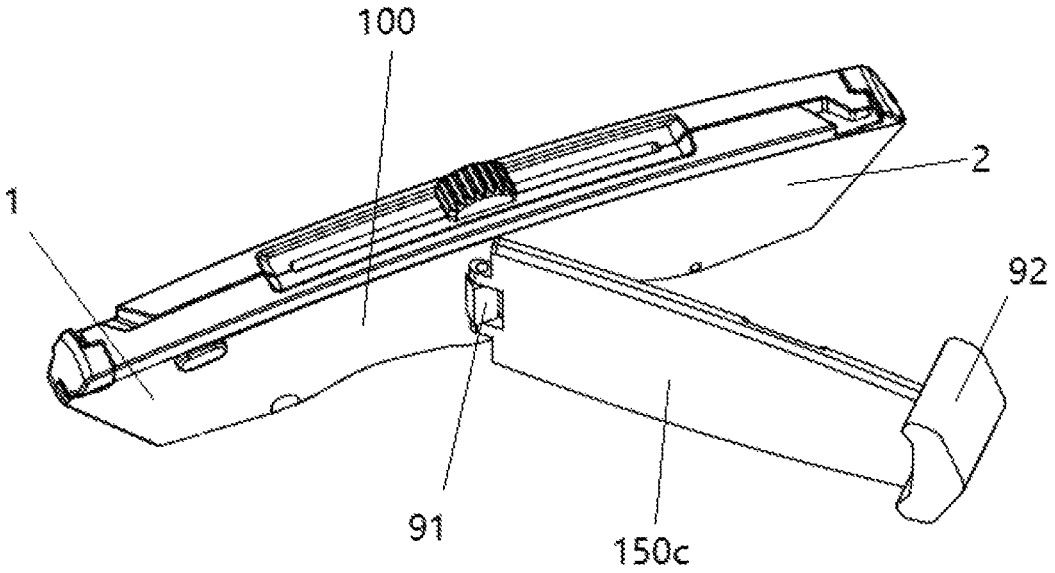
FIG. 29 is a schematic view of rotation of Embodiment 8 of a utility knife with dual blades according to the present utility model.

Referring to FIGS. 28 and 29, and other related figures, a utility knife with dual blades is characterized in that it includes a housing 100 having a first end 1 and a second end 2; a blade carrier for carrying two blades 3, 4 at both ends, respectively, which is mounted and is movable within the housing 100 so as to enable the blade to extend from either of the first end 1 and the second end 2 of the housing 100; and a movable member 150*c* for movably moving to the other end opposite to either of the first end 1 or the second end 2 so as to block the blade from extending from the other end opposite to either of the first end 1 or the second end 2. One end of the movable member 150*c* is connected to the intermediate portion of the housing 100 and the other end can move to the first end 1 or the second end 2 of the housing 100, respectively, and the other end of the movable member is connected to a guard for guarding at the first end 1 or the second end 2. One end of the movable member 150*c* is connected to the intermediate portion of the housing 100 via a hinge shaft 91, so that the other end of the movable member 150*c* can be turned to both sides of the housing 100, respectively, as two parts of a hinge. Specifically, the intermediate portion of the housing 100 has a first connecting body projecting outwardly and having a transverse through hole and a second connecting body having a transverse through hole, the movable member 150*c* is located on both sides of the first connecting body. There is a shaft 91 which laterally passes through the through holes of the first connecting body and the second connecting body so that the movable member 150*c* is movably connected to the intermediate portion of the housing 100. The other end of the movable member 150*c* is connected to a guard 92 for guarding at the outer edges of the first end 1 and the second end 1. Specifically, the intermediate portion of the guard 92 is connected, as such, when the movable member 150*c* is turned to the first end 1 and the second end 2 of the housing 100, respectively, the portions at both ends of the intermediate position can be used to guard the first end 1 and the second end 2 of the housing 100, respectively. The utility knife with dual blades according to the present utility model includes a first blade 3 and a second blade 4 which are respectively mounted at both ends of the blade carrier and can respectively extend from the first end 1 and the second end 2 of the housing 100, the first blade 3 and the second blade 4 may be the same or different, and the other parts is the same as those of Embodiment 4 or Embodiment 5.

Embodiment 9

As shown in FIGS. 20-23 and 30, and in conjunction with other related figures, a utility knife with dual blades includes a housing 100 having a first end and a second end; a blade carrier 110 for carrying two blades at both ends, which is mounted and is movable within the housing 100 to enable the blade to extend from either of the first end and the second end of the housing 100; and a movable member 150 for movably moving to the other end opposite to either of the first end or the second end so as to block the blade from extending from the other end opposite to either of the first end or the second end. One end of the movable member 150 is connected to the intermediate portion of the housing 100 via a shaft and the other end is rotatable about the shaft so as to be movable to the first end and the second end of the housing, respectively.

The utility knife with dual blades of this embodiment further includes a movement assembly 120 provided on the outside of the housing 100 and connected to the blade carrier 110 for driving the blade carrier 110 to move in a direction towards the first end or the second end of the housing 100.

The housing 100 includes an upper housing 101 located on the upper side and a lower housing 102 located on the lower side. The movable member 150 includes a first movable member 151 and a second movable member 152 which are located on both sides of the housing 100, respectively. The first movable member 151 is connected to the upper housing 101 via a first shaft 18 and the second movable member 152 is connected to the lower housing 102 via a second shaft 19, and the first shaft 18 and the second shaft 19 may be two portions at both ends of an integral shaft or may be two separate shafts at both ends of one axis so that the movable member 150 is rotatable about the housing 100 to be movable to both ends of the housing 100, i.e., the first end or the second end, respectively. The first shaft 18 and the second shaft 19 are specifically, for example, screw head nails, a first movable member 151 and a second movable member 152 and the upper housing 101 and the lower housing 102 have through-holes; the first shaft 18, i.e., the screw head nail as shown, connects the first movable member 151 with the upper housing 101 through the handle hole 158 in the first movable member 151 and the housing hole 159 in the upper housing 101, and the second shaft 19 connects the second movable member 152 with the lower housing 102 through the through holes in the second movable member 152 and the lower housing 102.

The movable member 150 further includes a through hole located at the end of the movable member 150 adjacent to the end of the housing 100 and a button located in the through hole, and in this embodiment, the through hole is rectangular as shown, and it may also be a dome shape or circular or other shapes. The movable member 150 further includes an elastic body 155' connected to the rear portion of the button, as such, when the button is pressed, the button can be pressed out of the through hole of the movable member 150 to move to outside the inner side of the movable member 150. As such, normally, the button is located inside the through hole, the movable member 150 cannot move; when the button is pressed, the button is pressed out of the through hole of the movable member 150 so that the movable member 150 can move about the shaft and can move to both sides of the housing 100, respectively.

In this specific embodiment, the first movable member 151 and the second movable member 152 of the movable member 150 have a first through hole 153*a*, a first button 154*a* and a second through hole 153*b*, a second button 154*b* in positions adjacent to the ends, respectively, and the first button 154*a* is located in the first through hole 153*a* and the second button 154*b* is located in the second through hole 153*b*. When two fingers are used on both sides of the movable member 150, i.e., on the first button 154*a* and the second button 154*b* of the first movable member 151 and the second movable member 152, the two fingers press the buttons at the same time when in use, and the two buttons are simultaneously pressed out of the movable member 150, so that the movable member 150 can move about the shaft, and can move to both sides of the housing 100, respectively.

The first button 154*a* and the second button 154*b* are connected via the elastic body 155', and may be formed integrally with the elastic body. The elastic body 155' can support the first button 154*a* and the second button 154*b* and simultaneously compress them into the first movable member 151 and the second movable member 152. The elastic body 155' is connected in the first button 154*a* and the second button 154*b*, and is a curved shape so that it can be compressed. Specifically, it may be S-shaped, hill-shaped, and the like. In this specific embodiment, the elastic body 155' includes a first portion 155*a*, a second portion 155*b* and a third portion 155*c*, the first portion 155*a* and the third portion 155*c* are connected to the first button 155*a* and the second button 155*b*, respectively, have a void therebetween and extend towards the same side, and the second portion 155*b* is located between the first portion 155*a* and the third portion 155*c*, both ends of which are connected to the first portion 155*a* and the third portion 155*c*, respectively, is above the void and extends towards the opposite side. The position of the elastic body 155' is outside the end of the housing 100 and does not interfere with the housing 100. Openings may also be formed on the housing 100 and the blade carrier 110, leaving room for the elastic body 155'. The material of the elastic body 155' can be plastic, perspex, resin and so on.

Further, the utility knife with dual blades according to the present utility model further includes an element 180' connected to the first shaft 18 or the second shaft 19 of the movable member 150, such as connected to the first shaft 18, and which is rotatable along with the rotation of the movable member 150, the element has two bosses, i.e., a first boss 81 and a second boss which are located on both sides of the element, respectively. The intermediate portion of the blade carrier has two ribs on both sides, i.e., a first rib 82 and a second rib.

Figure 30:
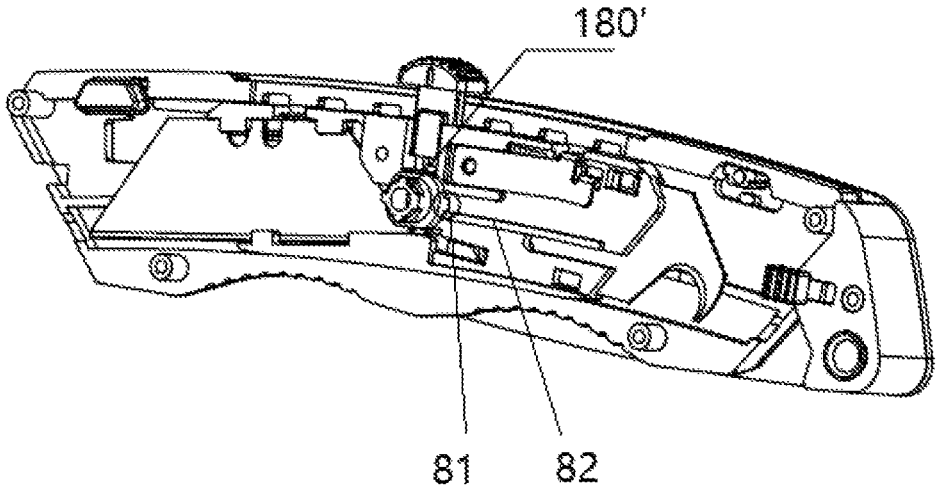
FIG. 30 is a schematic view of an internal structure of Embodiment 9 of a utility knife with dual blades according to the present utility model.

The element connected to the first shaft 18 or the second shaft 19 also rotates therewith when the movable member 150 rotates to one end of the housing 100. The blade carrier 110 is then moved towards the second end of the housing 100 to push the blade out. In this case, the second end is the working end and the first end is the non-working end. As shown in FIG. 30, the first boss 81 is blocked by the first rib 82 and cannot be rotated continuously, so that the movable member 150 is also fixed and cannot rotate, thereby achieving the purpose of protecting the non-working end. When the movable member 150 rotates to the other end of the housing 100, similarly, the element connected to the first shaft 18 or the second shaft 19 rotates therewith, and the blade carrier 110 is then moved towards the first end of the housing 100 to push the blade out. In this case, the first end is the working end, and the second end is the non-working end. At this time, the second boss is blocked by the second rib and cannot be rotated continuously, thereby achieving the purpose of protecting the non-working end.

The other parts of this embodiment are the same as those of Embodiment 5 or are referred to the other embodiments, and also may be provided in the same or different ways with the other embodiments, which are within the scope of the present utility model.

Embodiment 10

Figure 31:
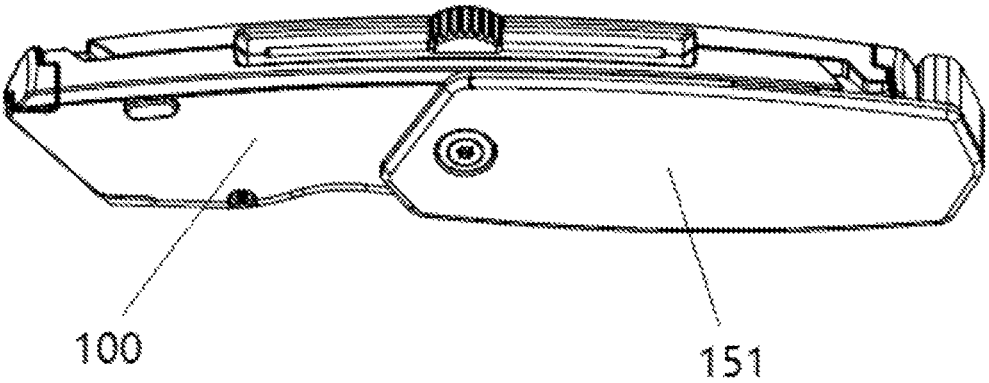
FIG. 31 is an external view of Embodiment 10 of a utility knife with dual blades according to the present utility model.
Figure 32:
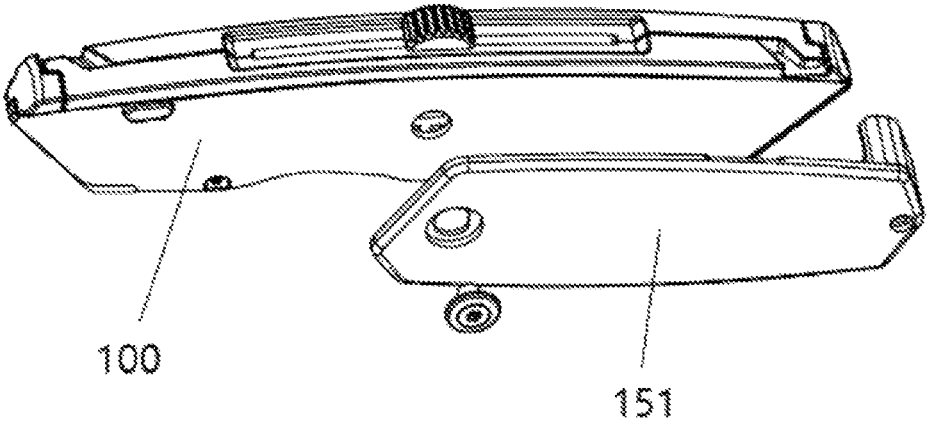
FIG. 32 is an exploded view of Embodiment 10 of a utility knife with dual blades according to the present utility model.

Referring to FIGS. 31 and 32, and Embodiment 4 of FIGS. 12-19, with respect to Embodiment 4, the movable member of this embodiment is located only on one side of the housing 100, such as the first movable member 151, and the other parts are the same as those of Embodiment 4.

The above description is only a description of the preferred embodiments of the present utility model, and is not a specific limit to the scope of the present utility model, any changes or modifications made by those having ordinary skill in the art of the present utility model according to the spirit of the utility model described above are within the scope of the claims.

The invention claimed is:

1. A utility knife with dual blades, comprising:

a housing having a first end and a second end, a blade carrier for carrying the dual blades at both ends thereof, respectively, which is mounted within the housing so that the dual blades can extend from either of the first end and the second end of the housing, respectively; and a movable member connected to the housing and being configured to be translated or rotated with respect to the housing, and being movable to one of the first end and the second end which none of the blades extends from so as to block corresponding one of the blades from extending out from the one of the first end and the second end;

wherein one end of the movable member is connected to an intermediate portion of the housing via a shaft so that the movable member is rotatable about the shaft so as to be movable to the first end or the second end of the housing;

wherein the movable member further comprises a through hole located in the movable member, a button capable of passing though the through hole, and an elastic member connected to the button.

2. The utility knife with dual blades as claimed in claim 1, wherein the housing has a button hole in a position corresponding to the button thereon, for accommodating the button on the movable member.

3. The utility knife with dual blades as claimed in claim 2, wherein when the blade carrier is in an intermediate position of the housing, a groove is provided in a position corresponding to the button hole on the blade carrier, the groove being engaged with the button and the elastic member; and only when the blade carrier is in the intermediate position of the housing, the elastic member can be engaged with the groove through the button hole so that the elastic member can be compressed within the groove.

4. The utility knife with dual blades as claimed in claim 1, further comprising a rotating member located between the housing and the blade carrier, which is connected to the movable member via a shaft, and is rotatable along with the rotation of the movable member, the rotating member has a blocking portion located on one side portion of the rotating member, and the blocking portion is rotated on the rotating member to the side adjacent to the movable member when the movable member rotates to one of the first end and the second end of the housing, so as to block the blade carrier from moving towards the one of the first end and the second end at which the movable member is located.

5. The utility knife with dual blades as claimed in claim 4, wherein a forwardly projecting boss is provided on an intermediate portion of the blade carrier, and the blocking portion is located on the side of the boss adjacent to the movable member when the movable member rotates to the one of the first end and the second end of the housing so that the blocking portion can block the boss on the blade carrier from moving towards the one of the first end and the second end at which the movable member is located.

6. The utility knife with dual blades as claimed in claim 1, wherein a structural body and a pin are provided at a rear portion of the movable member, wherein the structural body has a pin hole in the center thereof, and the pin is connected to the movable member through the pin hole.

7. The utility knife with dual blades as claimed in claim 6, wherein the structural body is connected to an elastic structure which is fixedly connected to or integrally extends with an intermediate portion of the structural body, wherein the elastic structure comprises two fins which respectively extend towards both sides of the elastic structure from an intermediate portion of the elastic structure and project inwardly at a respective end of each of the two fins.

8. The utility knife with dual blades as claimed in claim 1, wherein the movable member comprises a first movable member and a second movable member each located on a respective side of the housing, wherein the first movable member is connected to an upper housing located on an upper side of the housing via a first shaft, and the second movable member is connected to a lower housing located on a lower side of the housing via a second shaft, wherein the first shaft and the second shaft can be two portions of an integral shaft or can be two co-axial shafts.

9. The utility knife with dual blades as claimed in claim 8, wherein the first movable member comprises a first through and a first button, and the second movable member comprises a second through hole and a second button, wherein the first button is located in the first through hole and the second button is located in the second through hole, wherein the first button and the second button are connected via an elastic body or are integrally formed with the elastic body.

10. The utility knife with dual blades as claimed in claim 9, further comprising an element connected to the movable member via a shaft and rotatable along with the rotation of the movable member, the element has a boss located on a side portion of the element, and the blade carrier is moved towards the second end of the housing when the movable member rotates to the first end of the housing, the blade carrier has a rib thereon, at which time the boss is blocked by the rib and the movable member cannot rotate.

* * * * *